US010737150B2

(12) United States Patent
Petersen et al.

(10) Patent No.: US 10,737,150 B2
(45) Date of Patent: Aug. 11, 2020

(54) GOLF CLUB HEADS WITH INSERT AND RELATED METHODS

(71) Applicant: KARSTEN MANUFACTURING CORPORATION, Phoenix, AZ (US)

(72) Inventors: David L. Petersen, Peoria, AZ (US); Ryan M. Stokke, Anthem, AZ (US); Cory S. Bacon, Cave Creek, AZ (US); Eric J. Morales, Laveen, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 16/542,656

(22) Filed: Aug. 16, 2019

(65) Prior Publication Data

US 2020/0038718 A1 Feb. 6, 2020

Related U.S. Application Data

(63) Continuation of application No. 15/280,828, filed on Sep. 29, 2016, now Pat. No. 10,420,991, which is a continuation-in-part of application No. 14/623,899, filed on Feb. 17, 2015, now Pat. No. 9,545,548.

(60) Provisional application No. 62/235,329, filed on Sep. 30, 2015, provisional application No. 62/235,949, filed on Oct. 1, 2015, provisional application No. 62/241,929, filed on Oct. 15, 2015, provisional application No. 62/248,174, filed on Oct. 29, 2015, provisional application No. 61/940,831, filed on Feb. 17, 2014.

(51) Int. Cl.

| | |
|---|---|
| ***A63B 53/04*** | (2015.01) |
| ***A63B 60/54*** | (2015.01) |
| ***A63B 53/08*** | (2015.01) |
| *A63B 60/00* | (2015.01) |

(52) U.S. Cl.

CPC ..... *A63B 53/047* (2013.01); *A63B 53/04* (2013.01); *A63B 53/0475* (2013.01); *A63B 53/08* (2013.01); *A63B 60/54* (2015.10); *A63B 2053/0408* (2013.01); *A63B 2053/0412* (2013.01); *A63B 2053/0479* (2013.01); *A63B 2053/0491* (2013.01); *A63B 2060/002* (2015.10); *A63B 2209/00* (2013.01)

(58) Field of Classification Search

CPC .... A63B 53/09; A63B 53/047; A63B 59/0092
See application file for complete search history.

(56) References Cited

U.S. PATENT DOCUMENTS

| | | | | |
|---|---|---|---|---|
| 5,492,327 | A | 2/1996 | Biafore | |
| 5,807,191 | A | 9/1998 | Nakahara | |
| 6,015,354 | A | 1/2000 | Ahn et al. | |
| 6,086,485 | A | 7/2000 | Hamada et al. | |
| 6,193,614 | B1 | 2/2001 | Sasamoto et al. | |
| 6,368,231 | B1 | 4/2002 | Chen | |
| 6,592,469 | B2 * | 7/2003 | Gilbert | A63B 53/04 473/350 |
| 6,719,641 | B2 | 4/2004 | Dabbs et al. | |

(Continued)

OTHER PUBLICATIONS

International Search Report and Written Opinion of the International Searching Authority for International Application PCT/US2015/016122 filed May 20, 2015.

*Primary Examiner* — William M Pierce

(57) ABSTRACT

Some embodiments include a golf club head with an insert. Other embodiments for related golf club heads and methods are also disclosed.

18 Claims, 14 Drawing Sheets

(56) References Cited

U.S. PATENT DOCUMENTS 6,743,114 B2 * 6/2004 Best ..... A63B 53/04 473/291
6,835,144 B2 12/2004 Best
6,921,344 B2 * 7/2005 Gilbert ..... A63B 60/00 473/334
6,923,734 B2 8/2005 Meyer
7,025,695 B2 4/2006 Mitsuba
7,192,362 B2 * 3/2007 Gilbert ..... A63B 60/02 473/291
7,396,299 B2 * 7/2008 Nicolette ..... A63B 53/047 473/350
D581,000 S * 11/2008 Nicolette ..... D21/749
D621,893 S * 8/2010 Nicolette ..... D21/759
7,789,772 B2 9/2010 Sukman
D635,627 S * 4/2011 Nicolette ..... D21/759
7,976,403 B2 7/2011 Gilbert et al.
8,012,036 B2 9/2011 Nakamura
8,088,022 B2 1/2012 Soracco et al.
8,197,354 B2 * 6/2012 Gilbert ..... A63B 53/047 473/290
8,235,833 B2 8/2012 Best et al.
8,227,337 B2 10/2012 Jertson et al.
8,317,635 B2 * 11/2012 Gilbert ..... A63B 53/0475 473/335
8,337,325 B2 * 12/2012 Boyd ..... A63B 53/047 473/332
8,353,784 B2 1/2013 Boyd et al.
8,366,566 B1 2/2013 Rollinson
8,403,771 B1 3/2013 Rice et al.
8,647,218 B2 * 2/2014 Gilbert ..... A63B 53/047 473/346
8,657,700 B2 * 2/2014 Nicolette ..... A63B 53/047 473/291
8,753,230 B2 * 6/2014 Stokke ..... A63B 53/047 473/350
8,911,301 B1 12/2014 Allen
8,911,302 B1 12/2014 Ivanova et al.
8,951,141 B2 2/2015 Mizutani
9,005,048 B2 * 4/2015 Jertson ..... A63B 53/047 473/324
9,079,080 B2 * 7/2015 Jertson ..... A63B 53/047
9,950,219 B2 * 4/2018 Larson ..... A63B 60/52
10,022,601 B2 * 7/2018 Petersen ..... A63B 60/02
10,112,084 B2 * 10/2018 Stokke ..... A63B 53/047
2001/0055996 A1 12/2001 Iwata et al.
2002/0042307 A1 4/2002 Deshmukh
2002/0098910 A1 7/2002 Gilbert
2003/0032499 A1 2/2003 Wahl et al.
2003/0092502 A1 5/2003 Pergande et al.
2003/0119602 A1 6/2003 Kennedy et al.
2003/0157995 A1 8/2003 Mahaffey
2004/0242339 A1 12/2004 Gilbert et al.
2005/0020376 A1 1/2005 Huang
2005/0020384 A1 1/2005 Hou
2005/0148407 A1 7/2005 Gilbert
2005/0181888 A1 8/2005 Hou et al.
2006/0035721 A1 2/2006 Knutson et al.
2006/0199661 A1 9/2006 Deng et al.
2006/0199662 A1 9/2006 Cole
2007/0049403 A1 3/2007 Chen
2007/0129162 A1 6/2007 Pan et al.
2007/0155534 A1 7/2007 Tsai
2008/0058113 A1 3/2008 Nicolette
2008/0076597 A1 3/2008 Roach et al.
2011/0250985 A1 10/2011 Stites
2012/0077613 A1 3/2012 Jertson et al.
2013/0324301 A1 12/2013 Boyd et al.
2013/0331201 A1 12/2013 Wahl et al.
2014/0038737 A1 2/2014 Roach et al.
2014/0274455 A1 9/2014 Jertson et al.
2015/0231458 A1 2/2015 Peterson et al.

* cited by examiner

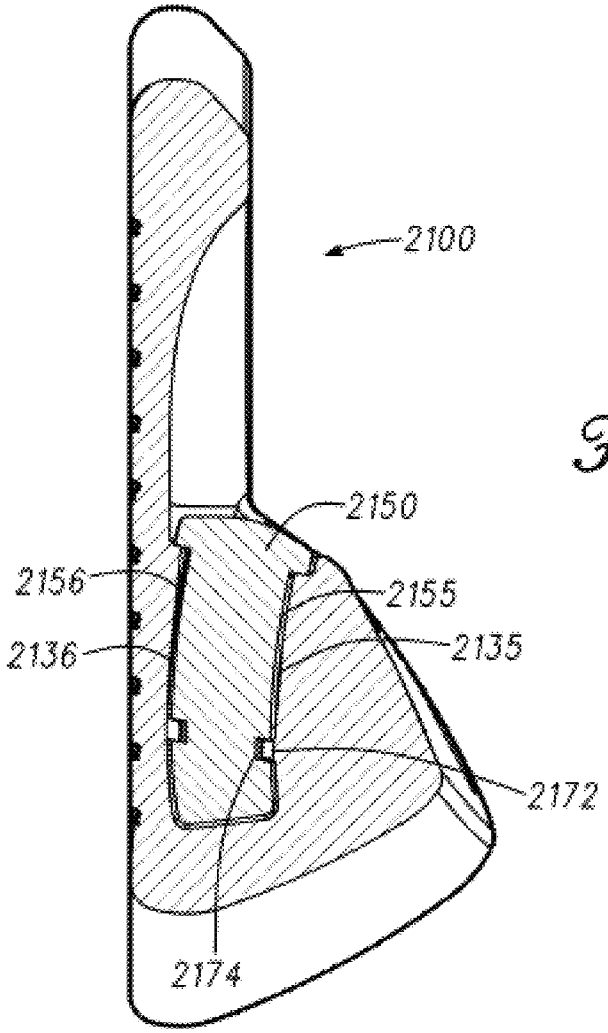
Fig. 22
Fig. 23
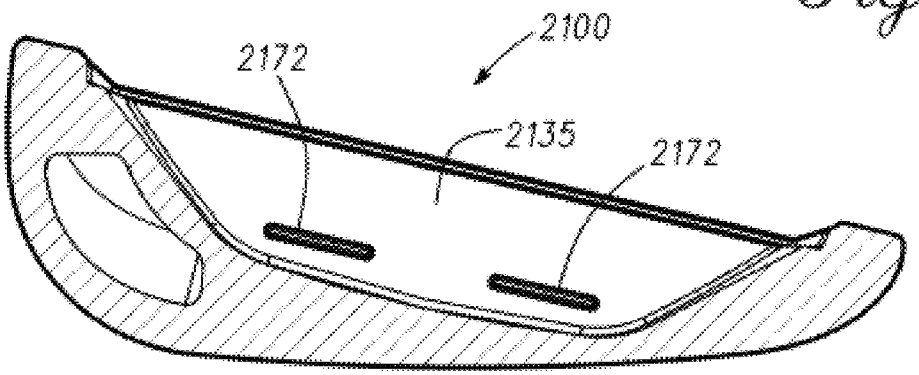

GOLF CLUB HEADS WITH INSERT AND RELATED METHODS

CROSS REFERENCE TO RELATED APPLICATIONS

This is a continuation of U.S. patent application Ser. No. 15/280,828 filed on Sep. 29, 2016, which claims the benefit of U.S. Provisional Patent Application No. 62/235,329, filed on Sep. 30, 2015, U.S. Provisional Patent Application No. 62/235,949, filed on Oct. 1, 2015, U.S. Provisional Patent Application No. 62/241,929, filed on Oct. 15, 2015, U.S. Provisional Patent Application No. 62/248,174, filed on Oct. 29, 2015, and is a continuation in part of U.S. patent application Ser. No. 14/623,899, filed on Feb. 17, 2015, now U.S. Pat. No. 9,545,548 issued on Jan. 17, 2017, which claims the benefit of U.S. Provisional Patent Application No. 61/940,831, filed on Feb. 17, 2014, the contents of all of which are incorporated herein by reference in their entirety.

TECHNICAL FIELD

This disclosure relates generally to sports equipment, and relates more particularly to golf club heads and related methods.

BACKGROUND

Golf club heads often include various features that can be designed or configured to improve one or more characteristics of their respective golf club heads. For example, tuning elements may be added to adjust or restrict impact vibrations upon impact with a golf ball, and/or to reinforce some features of the golf club head. The addition of such tuning elements, however, may detrimentally affect some other characteristics of the golf club heads, such as by adding extra mass, by repositioning the center of gravity of the golf club head towards one or more less desirable locations, and/or by decreasing durability of the golf club head. Additionally, manufacturing golf club heads having certain port structures for tuning elements can involve complex processes. Furthermore, tuning elements sometimes can become inadvertently dislodged from port structures in various port structure designs and/or tuning element designs. Accordingly, further developments with respect to positioning of golf club tuning elements can enhance the performance and/or manufacturability of golf clubs.

BRIEF DESCRIPTION OF THE DRAWINGS

To facilitate further description of the embodiments, the following drawings are provided in which:

FIG. 22 illustrates another cross-sectional view of the golf club head with the insert of FIG. 21.

FIG. 23 illustrates another cross-sectional view of the golf club head with the insert of FIG. 21.

Figure 1:
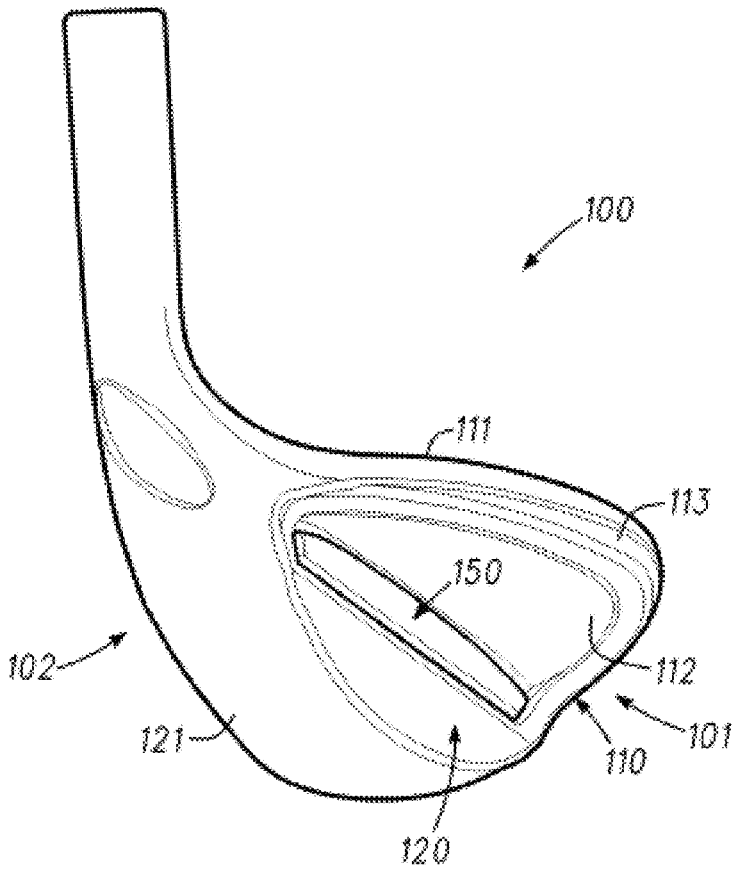
FIG. 1 illustrates a heel-side, bottom, rear perspective view of a golf club head with a tuning element, according to an embodiment.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements mechanically and/or otherwise. Two or more mechanical elements may be mechanically coupled together, but not be electrically or otherwise coupled together. Coupling may be for any length of time, e.g., permanent or semi-permanent or only for an instant. "Mechanical coupling" and the like should be broadly understood and include mechanical coupling of all types.

The absence of the word "removably," "removable," and the like near the word "coupled," and the like does not mean that the coupling, etc. in question is or is not removable.

As defined herein, two or more elements are "integral" if they are comprised of the same piece of material. As defined herein, two or more elements are "non-integral" if each is comprised of a different piece of material.

As defined herein, "approximately" can, in some embodiments, mean within plus or minus ten percent of the stated value. In other embodiments, "approximately" can mean within plus or minus five percent of the stated value. In further embodiments, "approximately" can mean within plus or minus three percent of the stated value. In yet other embodiments, "approximately" can mean within plus or minus one percent of the stated value.

DESCRIPTION OF EXAMPLES OF EMBODIMENTS

Some embodiments include a golf club head. The golf club head includes a strike portion including a strikeface and a backface opposite the strikeface. The backface includes a perimeter portion at a top end of the backface. The golf club head further includes a rear portion coupled to the strike portion at a bottom end of the strike portion. The golf club head additional includes a port structure at least partially defined within the rear portion. The port structure includes a slot extending from a slot opening to a slot base. The bottom end of the strike portion is located closer to the slot base than the slot opening. The slot includes a heel wall and a toe wall. The slot further includes a rear wall extending from the slot opening to the slot base, and extending between the heel wall and the toe wall. The rear wall includes a first rear wall curve along a first direction extending between the slot opening and the slot base. The slot further includes a front wall extending from the slot opening to the slot base, and extending between the heel wall and the toe wall. The strike face being located closer to the front wall than the rear wall. The front wall includes a first front wall curve along the first direction.

Additional embodiments include a method of providing a golf club head. The method includes providing a strike portion. The strike portion includes a strikeface and a backface opposite the strikeface. The backface includes a perimeter portion at a top end of the backface. The method further includes providing a rear portion coupled to the strike portion at a bottom end of the strike portion. The method additionally includes providing a port structure at least partially defined within the rear portion. The port structure includes a slot extending from a slot opening to a slot base. The method also includes coupling a tuning element to the port structure. The bottom end of the strike portion is located closer to the slot base than the slot opening. The slot includes a heel wall and a toe wall. The slot also includes a rear wall extending from the slot opening to the slot base, and extending between the heel wall and the toe wall. The rear wall includes a first rear wall curve along a first direction extending between the slot opening and the slot base. The slot further includes a front wall extending from the slot opening to the slot base, and extending between the heel wall and the toe wall. The strike face being located closer to the front wall than the rear wall. The front wall includes a first front wall curve along the first direction.

Further embodiments include a method of forming a golf club head. The method can include providing a first mold piece including a first cavity portion and a tooling piece. The tooling piece can be configured to rotate with respect to the first mold piece about a fixed point on the first mold piece from a mold position to a release position. The method also can include providing a second mold piece including a second cavity portion. The method further can include closing the second mold piece to the first mold piece such that the first and second mold pieces surround the first and second cavity portions, the tooling piece can be in the mold position, and a portion of the tooling piece can be inserted into at least the first cavity portion. The method additionally can include molding an injection mold in the first and second cavity portions. The injection mold can include a golf club head mold including a strike portion, a rear portion, and a port structure at least partially defined within the rear portion. The portion of the tooling piece can be conformal with the port structure. The method further can include opening the second mold piece from the first mold piece such that the tooling piece can be rotated about the fixed point away from the mold position in the port structure to the release position.

Various embodiments include a golf club head. The golf club head includes a strike portion including a strikeface and a backface opposite the strikeface. The backface includes a perimeter portion at a top end of the backface. The golf club head further includes a rear portion coupled to the strike portion at a bottom end of the strike portion. The golf club head additional includes a port structure at least partially defined within the rear portion. The port structure includes a slot extending from a slot opening to a slot base. The bottom end of the strike portion is located closer to the slot base than the slot opening. The slot includes a heel wall and a toe wall. The slot further includes a rear wall extending from the slot opening to the slot base, and extending between the heel wall and the toe wall. The rear wall includes a first rear wall curve along a first direction extending between the slot opening and the slot base. The slot further includes a front wall extending from the slot opening to the slot base, and extending between the heel wall and the toe wall. The strike face being located closer to the front wall than the rear wall. The front wall includes a first front wall curve along the first direction. A minimum lower thickness of the strikeface measured from the strikeface to the front wall is less than a minimum upper thickness of the strikeface measured from the strikeface to the backface.

Some embodiments include a golf club. The golf club includes a golf club head and a shaft coupled to the golf club head. The golf club head includes a strike portion including a strikeface and a backface opposite the strikeface. The backface includes a perimeter portion at a top end of the backface. The golf club head further includes a rear portion coupled to the strike portion at a bottom end of the strike portion. The golf club head additional includes a port structure at least partially defined within the rear portion. The port structure includes a slot extending from a slot opening to a slot base. The bottom end of the strike portion is located closer to the slot base than the slot opening. The slot includes a heel wall and a toe wall. The slot further includes a rear wall extending from the slot opening to the slot base, and extending between the heel wall and the toe wall. The rear wall includes a first rear wall curve along a first direction extending between the slot opening and the slot base. The slot further includes a front wall extending from the slot opening to the slot base, and extending between the heel wall and the toe wall. The strike face being located closer to the front wall than the rear wall. The front wall includes a first front wall curve along the first direction. A minimum lower thickness of the strikeface measured from the strikeface to the front wall is less than a minimum upper thickness of the strikeface measured from the strikeface to the backface.

Additional embodiments include a method of providing a golf club head. The method includes providing a strike portion. The strike portion includes a strikeface and a backface opposite the strikeface. The backface includes a perimeter portion at a top end of the backface. The method further includes providing a rear portion coupled to the strike portion at a bottom end of the strike portion. The method additionally includes providing a port structure at least partially defined within the rear portion. The port structure includes a slot extending from a slot opening to a slot base. The method also includes coupling a tuning element to the port structure. The bottom end of the strike portion is located closer to the slot base than the slot opening. The slot includes a heel wall and a toe wall. The slot also includes a rear wall extending from the slot opening to the slot base, and extending between the heel wall and the toe wall. The rear wall includes a first rear wall curve along a first direction extending between the slot opening and the slot base. The slot further includes a front wall extending from the slot opening to the slot base, and extending between the heel wall and the toe wall. The strike face being located closer to the front wall than the rear wall. The front wall includes a first front wall curve along the first direction. A minimum lower thickness of the strikeface measured from the strikeface to the front wall is less than a minimum upper thickness of the strikeface measured from the strikeface to the backface.

Figure 2:
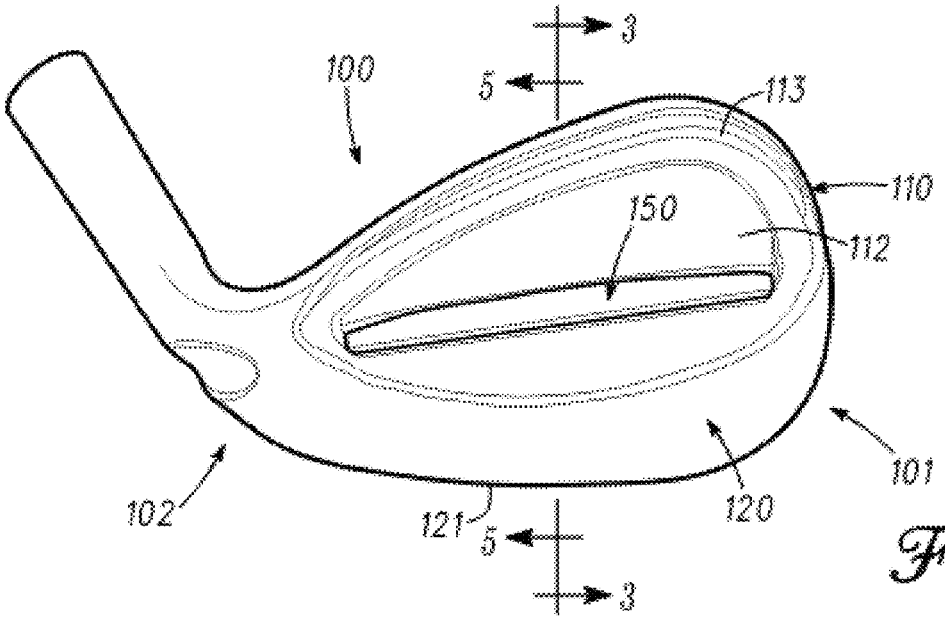
FIG. 2 illustrates a bottom, rear view of the golf club head of FIG. 1 with the tuning element of FIG. 1.

Turning to the drawings, FIG. 1 illustrates a heel-side, bottom, rear perspective view of a golf club head 100 with an insert or tuning element 150, according to an embodiment. FIG. 2 illustrates a bottom, rear view of golf club head 100 with tuning element 150. Golf club head 100 is merely exemplary and embodiments of the golf club head are not limited to the embodiments presented herein. The golf club head can be employed in many different embodiments or examples not specifically depicted or described herein. In a number of embodiments, golf club head 100 can be an iron-type club head, a wedge-type club head, or a hybrid-type club head. For example, in some embodiments, golf club head 100 can have a loft angle of approximately 15 degrees to approximately 70 degrees. Further, in some embodiments, golf club head 100 can have a loft angle of greater than or equal to approximately 10 degrees, greater than or equal to approximately 15 degrees, greater than or equal to approximately 20 degrees, greater than or equal to approximately 25 degrees, greater than or equal to approximately 30 degrees, greater than or equal to approximately 15 degrees, greater than or equal to approximately 35 degrees, greater than or equal to approximately 40 degrees, greater than or equal to approximately 45 degrees, greater than or equal to approximately 50 degrees, greater than or equal to approximately 55 degrees, greater than or equal to approximately 60 degrees, or greater than or equal to approximately 65 degrees. In a number of embodiments, golf club head 100 can have a head weight of approximately 200 grams (g) to approximately 325 g. In various embodiments, golf club head 100 can have a lie angle of approximately 50 degrees to approximately 70 degrees. In many embodiments, golf club head 100 can include a toe end 101 and a heel end 102. In various embodiments, golf club head 100 can include a strike portion 110, which can include a strikeface 111 and a backface 112. In certain embodiments, strikeface 111 can be an insert, such as a strikeplate insert (not shown) in strike portion 110. In other embodiments, strikeface 111 can be integral with strike portion 110. Backface 112 can be opposite strikeface 111. In various embodiments, backface 112 can include a perimeter portion 113 at a top end of backface 112. In many embodiments, perimeter portion 113 can extend around the top end and sides of backface 112 at or proximate to toe end 101 and/or heel end 102. Perimeter portion 113 can protrude rearward from backface 112.

In various embodiments, golf club head 100 can include a rear portion 120. Rear portion 120 can be coupled to strike portion 110 at the bottom end of strike portion 110. Rear portion 120 can include a sole 121. In a number of embodiments, at least a portion of sole 121 can be substantially or approximately horizontal when golf club head 100 is at the address position, such that cross-sectional lines 3-3 and 5-5 can be substantially or approximately vertical when golf club head 100 is at the address position. In many embodiments, strike portion 110 can be integral with rear portion 120, such that strike portion 110 and rear portion 120 can be a single piece of material. In other embodiments, strike portion 110 can be a separate piece (or more than one separate piece) of material fastened to rear portion 120, such as by welding, brazing, adhering, and/or other mechanical or chemical fasteners. In many embodiments, rear portion 120 and/or strike portion 110 can include one or more materials, including ferrous materials such as steel, carbon steel, stainless steel, and/or steel alloys, and/or non-ferrous materials such as titanium, tungsten, and/or aluminum. In a number of embodiments, one or more of the materials used in rear portion 120 and/or strike portion 110 can have a high shear modulus and/or a high strength-to-weight ratio. In some embodiments, rear portion 120 and/or strike portion 110 can have a density of approximately 2.8 g per cubic centimeter (cc) (g/cc) to approximately 18.0 g/cc. For example, rear portion 120 and/or strike portion 110 can have a density of approximately 2.8 g/cc, 3.0 g/cc, 3.5 g/cc, 4.0 g/cc, 4.5 g/cc, 5.0 g/cc, 5.5 g/cc, 6.0 g/cc, 6.5 g/cc, 7.0 g/cc, 7.5 g/cc, 8.0 g/cc, 8.5 g/cc, 9.0 g/cc, 9.5 g/cc, 10.0 g/cc, 10.5 g/cc, 11.0 g/cc, 11.5 g/cc, 12.0 g/cc, 12.5 g/cc, 13.0 g/cc, 13.5 g/cc, 14.0 g/cc, 14.5 g/cc, 15.0 g/cc, 15.5 g/cc, 16.0 g/cc, 16.5 g/cc, 17.0 g/cc, 17.5 g/cc, 18.0 g/cc, or any other suitable density value in between those density values, and can range from any one of those density values to any other one of those density values. For example, rear portion 120 and/or strike portion 110 for certain hybrid-type golf club heads can have a density of approximately 4.0 g/cc to approximately 8.0 g/cc. As another example, rear portion 120 and/or strike portion 110 in certain iron-type golf club heads or certain wedge-type golf club heads can have a density of approximately 7.0 g/cc to approximately 8.0 g/cc. Rear portion 120 and/or strike portion 110 in other iron-type, wedge-type, and/or hybrid-type golf club heads can have other suitable densities.

Figure 4:
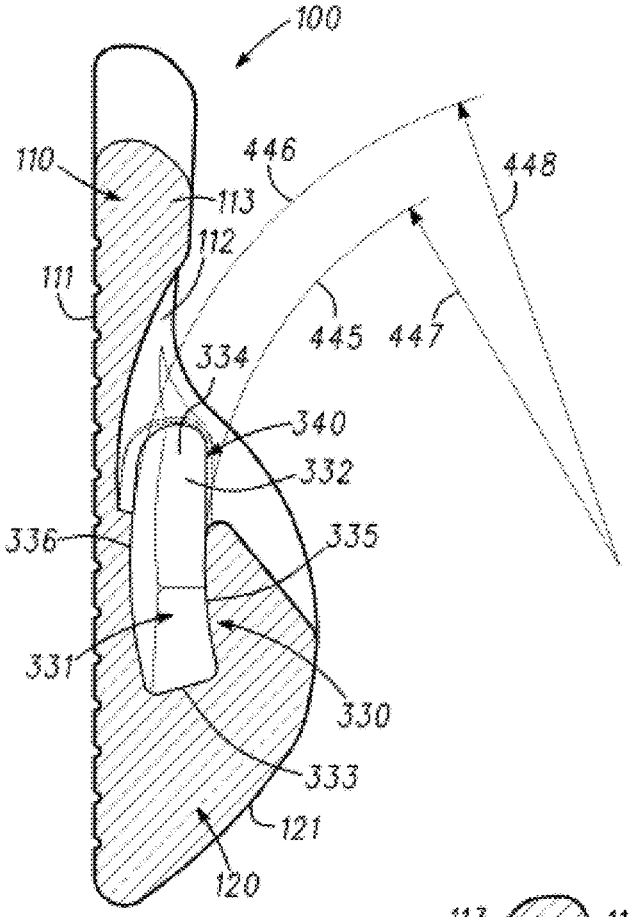
FIG. 4 illustrates a side cross-sectional view of the golf club head of FIG. 1, where the cross-sectional view is taken along cross-sectional line 3-3 in FIG. 2 and the golf club head in FIG. 4 is shown with radii of curvature and without the tuning element of FIG. 1.
Figure 3:
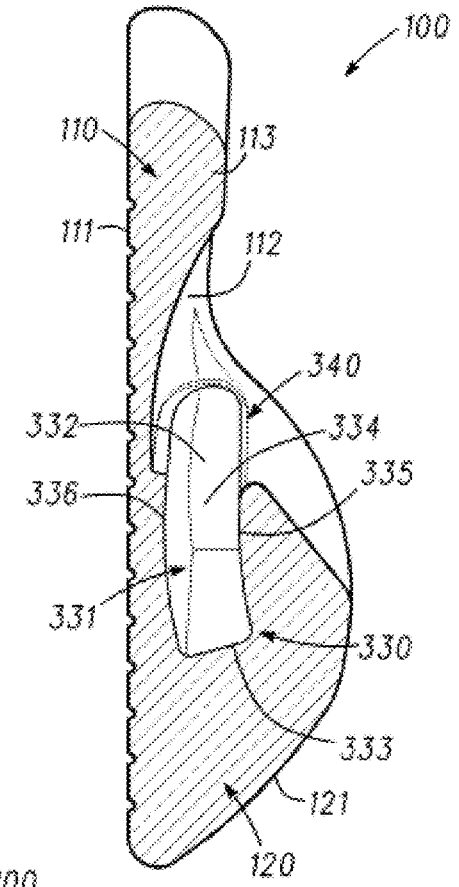
FIG. 3 illustrates a side cross-sectional view of the golf club head of FIG. 1, where the cross-sectional view is taken along cross-sectional line 3-3 in FIG. 2 and the golf club head in FIG. 3 is without the tuning element of FIG. 1.
Figure 5:
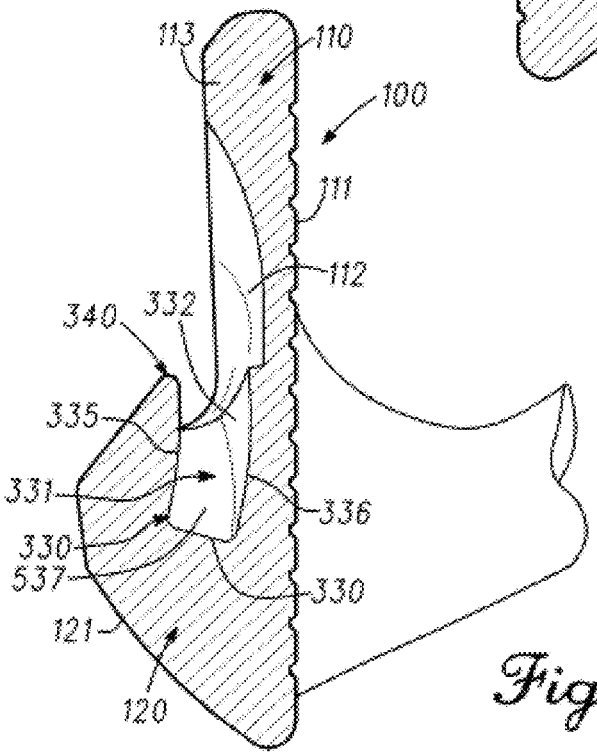
FIG. 5 illustrates a side cross-sectional view of the golf club head of FIG. 1, wherein the cross-sectional view if taken along cross-sectional line 5-5 in FIG. 2 and the golf club head in FIG. 5 is shown without the tuning element of FIG. 1.

In a number of embodiments, golf club head 100 can include tuning element 150 and a port structure for holding and/or securing tuning element 150, such as port structure 330 (as shown in FIGS. 3-5 and 9-11, and described below). Turning ahead in the drawings, FIG. 3 illustrates a side cross-sectional view of a golf club head 100, where the cross-sectional view is taken along cross-sectional line 3-3 in FIG. 2, but where golf club head 100 in FIG. 3 is illustrated without tuning element 150, according to an embodiment. FIG. 4 illustrates a side cross-sectional view of golf club head 100, where the cross-sectional view is taken along cross-sectional line 3-3 in FIG. 2, where golf club head 100 in FIG. 3 is illustrated with radii of curvature and without tuning element 150. FIG. 5. illustrates a side cross-sectional view of golf club head 100, where the cross-sectional view is taken along cross sectional line 5-5 in FIG. 2, but where golf club head 100 in FIG. 5 is illustrated without tuning element 150. In a number of embodiments, golf club head 100 can include a port structure 330. Port structure 330 can be at least partially defined within rear portion 120. In certain embodiments, port structure 330 can be at least partially defined within strike port 110. In many embodiments, port structure 330 can be defined within both rear portion 120 and strike portion 110. In certain other embodiments, port structure 330 can be defined solely within rear portion 120.

Figure 6:
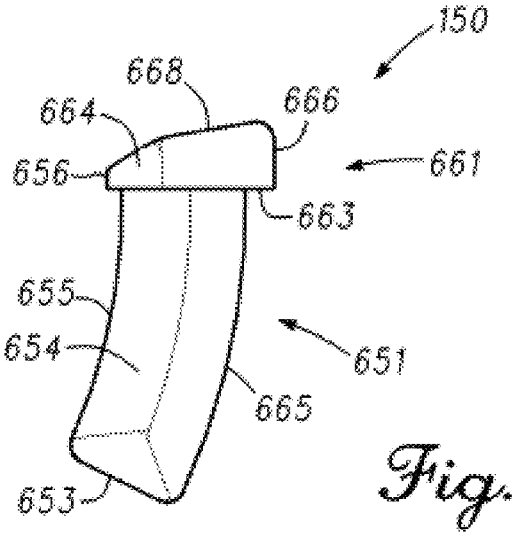
FIG. 6 illustrates a side view of the tuning element for the golf club head of FIG. 1.
Figure 7:
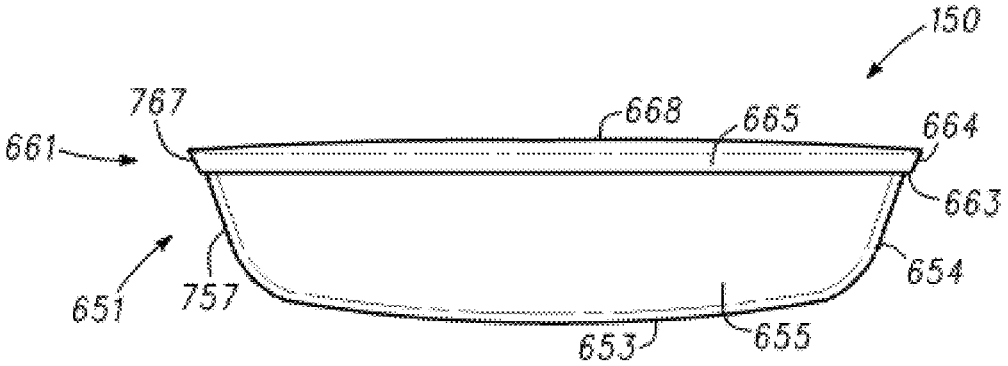
FIG. 7 illustrates a rear view of the tuning element of FIG. 1.
Figure 8:
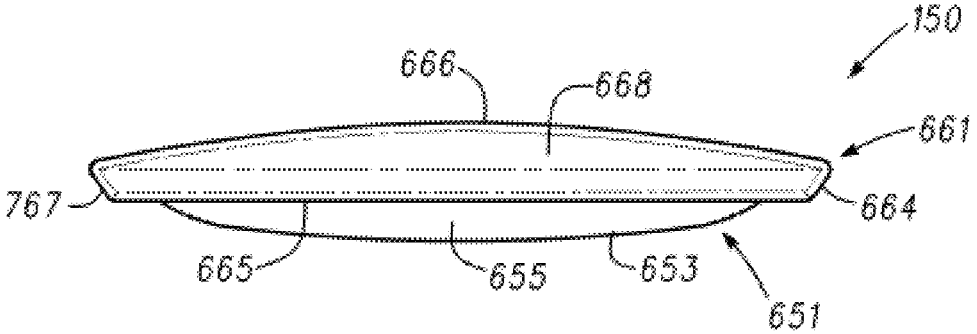
FIG. 8 illustrates a top view of the tuning element of FIG. 1.

In various embodiments, port structure 330 can include a slot 331, which can extend from a slot opening 332 to a slot base 333. In many embodiments, slot 331 can be configured to receive a main portion 651 (as shown in FIGS. 6-8, described below) of tuning element 150 (FIGS. 1-2), as described below in further detail. In many embodiments, slot 331 can include a toe wall 334 and a heel wall 537. Toe wall 334 can be at the side of golf club head 100 and/or slot 331 located closer to toe end 101 (FIGS. 1-2), and heel wall 537 can be at the side of golf club head 100 and/or slot 331 located closer to heel end 102 (FIGS. 1-2). Slot 331 can extend between toe wall 334 and heel wall 537. In many embodiments, toe wall 334 and/or heel wall 537 can extend from slot opening 332 to slot base 333. In a number of embodiments, slot 331 can include a rear wall 335 and a front wall 336. In various embodiments, rear wall 335 can extend from slot opening 332 to slot base 333, and/or can extend between heel wall 537 and toe wall 334. In some embodiments, front wall 336 can extend from slot opening 332 to slot base 333, and/or can extend between heel wall 537 and toe wall 334. Slot 331 can extend between front wall 336 and rear wall 335. In a number of embodiments, strike face 111 can be located closer to front wall 336 than rear wall 335. In some embodiments, front wall 335 also can be located closer to strikeface 111 than rear wall 335.

The interfaces between toe wall 334, rear wall 335, heel wall 537, and front wall 336 can be angled acutely, orthogonally, or obtusely, or can be rounded. For example, in some embodiments, slot 331 can be tubular, such that the interfaces between toe wall 334, rear wall 335, heel wall 537, and front wall 336 do not include an angled edge, but even so, slot 331 can still be considered to have a toe wall, a rear wall, a heel wall, and a front wall. In such embodiments, the toe wall is the portion of the tubular wall that is adjacent to toe end 101, and heel wall 537 is the portion of the tubular wall that is adjacent to heel end 102, and so on. In a number of other embodiments, heel wall 537 can be at an angle of greater than 90 degrees with respect to rear wall 335, and/or toe wall 334 can be at an angle of greater than 90 degrees with respect to rear wall 335. In various embodiments, heel wall 537 can be at an angle of less than 90 degrees with respect to rear wall 335, and/or toe wall 334 can be at an angle of less than 90 degrees with respect to rear wall 335. In several embodiments, heel wall 537 can be orthogonal with respect to rear wall 335, and/or toe wall 334 can be orthogonal with respect to rear wall 335. As suggested above, these angles can exist even if the walls do not include angled edges when transitioning to the next or adjacent wall. In a number of embodiments, heel wall 537 and/or toe wall 334 can be substantially or approximately straight. In other embodiments, heel wall 537 and/or toe wall 334 can be curved.

In many embodiments, port structure 330, slot 331, and/or one or more elements thereof can have an arcuate shape in one or more directions. For example, rear wall 335 can be curved and have a rear wall curve in a first direction extending between slot opening 332 and slot base 333, as shown in FIGS. 3-5. As another example, front wall 336 can be curved and have a front wall curve in the first direction extending between slot opening 332 and slot base 333, as shown in FIGS. 3-5. In several embodiments, the front wall curve and/or rear wall curve in the first direction extending between slot opening 332 and slot base 333 can have a circular, elliptical, oval, or other curved shape.

In many embodiments, such as shown in FIG. 4, the rear wall curve extending along the first direction of rear wall 335 can be a portion of a circle 445 having a radius 447, and/or the front wall curve extending along the first direction of front wall 336 can be a portion of a circle 446 having a radius 448. A center of circle 445 can be determined by drawing two lines normal to the curve of rear wall 335 and finding the intersection of the two lines. The intersection of the two lines normal to rear wall 335 is the center of circle 445. Similarly, a center of circle 446 can be determined by drawing two lines normal to the curve of front wall 336 and finding the intersection of the two lines. The intersection of the two lines normal to front wall 336 is the center of circle 446. In geometry, the curvature of a circle is the reciprocal of the radius of the circle. A circle with a small radius has a high curvature (smaller circles bend more sharply than larger circles), and a circle with a large radius has a small curvature. In some embodiments, a curvature of circle 445 is larger than a curvature of circle 446. In other embodiments, the curvature of circle 445 is smaller than the curvature of circle 446. In some embodiments, the curvature of circle 445 is approximately the same as the curvature of circle 446.

In many embodiments, radius 447 can be approximately 0.375 inch (0.9525 centimeter (cm)) to approximately 10.0 inches (25.4 cm). For example, radius 447 can be approximately 0.375 inch (0.9525 cm), 0.4 inch (1.016 cm), 0.45 inch (1.143 cm), 0.5 inch (1.27 cm), 0.55 inch (1.397 cm), 0.6 inch (1.524 cm), 0.65 inch (1.651 cm), 0.7 inch (1.778 cm), 0.75 inch (1.905 cm), 0.8 inch (2.032 cm), 0.85 inch (2.159 cm), 0.9 inch (2.286 cm), 0.95 inch (2.413 cm), 1.0 inch (2.54 cm), 1.05 inches (2.667 cm), 1.1 inches (2.794 cm), 1.15 inches (2.921 cm), 1.2 inches (3.048 cm), 1.25 inches (3.175 cm), 1.3 inches (3.302 cm), 1.35 inches (3.429 cm), 1.4 inches (3.556 cm), 1.45 inches (3.683 cm), 1.5 inches (3.81 cm), 1.55 inches (3.937 cm), 1.6 inches (4.064 cm), 1.65 inches (4.191 cm), 1.7 inches (4.318 cm), 1.75 inches (4.445 cm), 1.8 inches (4.572 cm), 1.85 inches (4.699 cm), 1.9 inches (4.826 cm), 1.95 inches (4.953 cm), 2.0 inches (5.08 cm), 2.1 inches (5.334 cm), 2.2 inches (5.588 cm), 2.3 inches (5.842 cm), 2.4 inches (6.096 cm), 2.5 inches (6.25 cm), 2.6 inches (6.604 cm), 2.7 inches (6.858 cm), 2.8 inches (7.112 cm), 2.9 inches (7.366 cm), 3.0 inches (7.62 cm), 3.25 inches (8.255 cm), 3.5 inches (8.89 cm), 3.75 inches (9.525 inches), 4.0 inches (10.16 cm), 4.5 inches (11.43 cm), 5.0 inches (12.7 cm), 5.5 inches (13.97 cm), 6.0 inches (15.24 cm), 6.5 inches (16.51 cm), 7.0 inches (17.78 cm), 7.5 inches (19.05 cm), 8.0 inches (20.32 cm), 8.5 inches (21.59 cm), 9.0 inches (22.86 cm), 9.5 inches (24.13 cm), 10.0 inches (25.4 cm), or any other suitable radius value in between those radius values, and can range from any one of those radius values to any other one of those radius values. In some embodiments, for example, radius 447 can be approximately 0.5 inch (1.27 cm) to approximately 1.5 inches (3.81 cm). For example, radius 447 can be approximately 1.0 inch (2.54 cm), such as shown in FIG. 4.

As shown in FIG. 4, radius 448 can be larger than radius 447. In many embodiments, radius 448 can be approximately 0.575 inch (1.4605 cm) to approximately 11.0 inches (27.94 cm). For example, radius 448 can be approximately 0.575 inch (1.4605 cm), 0.6 inch (1.524 cm), 0.65 inch (1.651 cm), 0.7 inch (1.778 cm), 0.75 inch (1.905 cm), 0.8 inch (2.032 cm), 0.85 inch (2.159 cm), 0.875 inch (2.2225 cm), 0.9 inch (2.286 cm), 0.95 inch (2.413 cm), 1.0 inch (2.54 cm), 1.05 inches (2.667 cm), 1.1 inches (2.794 cm), 1.15 inches (2.921 cm), 1.2 inches (3.048 cm), 1.25 inches (3.175 cm), 1.3 inches (3.302 cm), 1.35 inches (3.429 cm), 1.4 inches (3.556 cm), 1.45 inches (3.683 cm), 1.5 inches (3.81 cm), 1.55 inches (3.937 cm), 1.6 inches (4.064 cm), 1.65 inches (4.191 cm), 1.7 inches (4.318 cm), 1.75 inches (4.445 cm), 1.8 inches (4.572 cm), 1.85 inches (4.699 cm), 1.9 inches (4.826 cm), 1.95 inches (4.953 cm), 2.0 inches (5.08 cm), 2.1 inches (5.334 cm), 2.2 inches (5.588 cm), 2.3 inches (5.842 cm), 2.4 inches (6.096 cm), 2.5 inches (6.25 cm), 2.6 inches (6.604 cm), 2.7 inches (6.858 cm), 2.8 inches (7.112 cm), 2.9 inches (7.366 cm), 3.0 inches (7.62 cm), 3.25 inches (8.255 cm), 3.5 inches (8.89 cm), 3.75 inches (9.525 inches), 4.0 inches (10.16 cm), 4.5 inches (11.43 cm), 5.0 inches (12.7 cm), 5.5 inches (13.97 cm), 6.0 inches (15.24 cm), 6.5 inches (16.51 cm), 7.0 inches (17.78 cm), 7.5 inches (19.05 cm), 8.0 inches (20.32 cm), 8.5 inches (21.59 cm), 9.0 inches (22.86 cm), 9.5 inches (24.13 cm), 10.0 inches (25.4 cm), 10.5 inches (26.67 cm), 11.0 inches (27.94 cm), or any other suitable radius value in between those radius values, and can range from any one of those radius values to any other one of those radius values. In some embodiments, for example, radius 448 can be approximately 0.7 inch (1.778 cm) to approximately 1.7 inches (3.81 cm). For example, radius 447 can be approximately 1.0 inch (2.54 cm), such as shown in FIG. 4. In yet other embodiments, radius 448 can be approximately 0.875 inch (2.2225 cm) to approximately 11.0 inches (27.94 cm).

In a number of embodiments, circle 445 and circle 446 can be substantially or approximately concentric, such that a middle portion of front wall 336 between heel wall 537 and toe wall 334 can be a substantially or approximately constant distance from a middle portion of rear wall 335 between heel wall 537 and toe wall 334 when moving along the first direction. In the same or other embodiments, front wall 336 can be a substantially or approximately constant distance from rear wall 335 at any corresponding portion of front wall 336 and rear wall 334 when moving along the first direction. For example, in the cross-sectional slice shown in FIG. 4, radius 448 can be approximately 1.2 inches (3.048 cm), and front wall 336 can be approximately 0.2 inch (0.508 cm) from rear wall 335 when moving along the first direction. For manufacturing and/or assembly purposes, the distance between the middle portions of front wall 336 and rear wall 335 can be substantially or approximately constant even when the distance decreases slightly (e.g., up to ten percent (10%)) when moving along the first direction from slot opening 332 towards slot base 333. In many embodiments, front wall 336 can be approximately 0.025 inch (0.0635 cm) to approximately 0.5 inch (0.254 cm) from rear wall 335. For example, front wall 336 can be approximately 0.025 inch (0.0635 cm), 0.05 inch (0.127 cm), 0.075 inch (0.1905 cm), 0.1 inch (0.254 cm), 0.125 inch (0.3175 cm), 0.15 inch (0.381 cm), 0.175 inch (0.4445 cm), 0.2 inch (0.508 cm), 0.225 inch (0.5715 cm), 0.25 inch (0.635 cm), 0.275 inch (0.6985 cm), 0.3 inch (0.762 cm), 0.325 inch (0.8255 cm), 0.35 inch (0.889 cm), 0.375 inch (0.9525 cm), 0.4 inch (1.016 cm), 0.425 inch (1.0795 cm), 0.45 inch (1.143 cm), 0.475 inch (1.2065 cm), or 0.5 inch (1.27 cm) from rear wall 335 when moving along the first direction, or can be any other suitable distance in between those distance values, and can range from any one of those distance values to any other one of those distance values.

In other embodiments, circle 445 and circle 446 can have centers that are not concentric, such that front wall 336 can be a variable distance from rear wall 335 when moving along the first direction. In some embodiments, for example, the distance between front wall 336 and rear wall 335 can narrow when moving along the first direction extending from slot opening 332 to slot base 333, which can beneficially allow tuning element 150 (FIGS. 1-2) to be received more easily in port structure 330 and/or removed more easily from port structure 330 due at least in part from less friction of tuning element 150 against rear wall 335 and front wall 336 and/or little to no air remaining in an air pocket beneath tuning element 150. In some embodiments with the distance between front wall 336 and rear wall 335 narrowing when moving along the first direction extending from slot opening 332 to slot base 333, an air pocket is not formed at slot base 333. In other embodiments, the distance between front wall 336 and rear wall 335 can widen when moving along the first direction extending from slot opening 332 to slot base 333. In a number of embodiments, the distance between the center of circle 445 and the center of circle 446 can be approximately 0 inch (0 cm) to approximately 5.0 inch (12.7 cm). For example, the distance between the center of circle 445 and the center of circle 446 can be approximately 0 inch (0 cm), 0.005 inch (0.0127 cm), 0.01 inch (0.0254 cm), 0.015 inch (0.0381 cm), 0.02 inch (0.0508 cm), 0.025 inch (0.0635 cm), 0.03 inch (0.0762 cm), 0.04 inch (0.1016 cm), 0.05 inch (0.127 cm), 0.06 inch (0.1524 cm), 0.07 inch (0.1778 cm), 0.08 inch (0.2032 cm), 0.09 inch (0.2286 cm), 0.1 inch (0.254 cm), 0.125 inch (0.3175 cm), 0.15 inch (0.381 cm), 0.175 inch (0.4445 cm), 0.2 inch (0.508 cm), 0.225 inch (0.5715 cm), 0.25 inch (0.635 cm), 0.275 inch (0.6985 cm), 0.3 inch (0.762 cm), 0.35 inch (0.889 cm), 0.4 inch (1.016 cm), 0.45 inch (1.143 cm), 0.5 inch (1.27 cm), 0.6 inch (1.524 cm), 0.7 inch (1.778 cm), 0.8 inch (2.032 cm), 0.9 inch (2.286 cm), 1.0 inch (2.54 cm), 1.25 inches (3.175 cm), 1.5 inches (3.81 cm), 1.75 inches (4.445 cm), 2.0 inches (5.08 cm), 2.25 inches (5.715 cm), 2.5 inches (6.35 cm), 2.75 inches (6.985 cm), 3.0 inches (7.62 cm), 3.25 inches (8.255 cm), 3.5 inches (8.89 cm), 3.75 inches (9.525 cm), 4.0 inches (10.16 cm), 4.25 inches (10.795 cm), 4.5 inches (11.43 cm), 4.75 inches (12.065 cm), 5.0 inches (12.7 cm), or any other suitable distance in between those distance values, and can range from any one of those distance values to any other one of those distance values. When the centers of circles 445 and 446 are substantially or approximately concentric, the distances between the centers can be approximately 0 inch (0 cm) to 0.075 inch (0.1905 cm).

In some embodiments, such as shown in FIG. 4, the centers of circle 445 and circle 446 can be located closer to rear wall 335 than front wall 336, such that radius 447 can be smaller than radius 448. As shown in FIG. 4, front wall 336 can be concave in the first direction in slot 331 (as viewed from the perspective of inside slot 331), and/or rear wall 335 can be convex in the first direction in slot 331 (as viewed from the same perspective of inside slot 331). In other embodiments, front wall 336 can be convex in slot 331, and/or rear wall 335 can be concave in slot 331. In such embodiments, for example, the centers of circle 445 and circle 446 can be located closer to front wall 336 than rear wall 335, such that radius 448 can be smaller than radius 447. In some embodiments, a majority of front wall 336 and/or rear wall 335 can be substantially curved in the first direction. In several embodiments, the centers of circle 445 and/or circle 446 can be located outside of golf club head 100. In other embodiments, the centers of circle 445 and/or circle 446 can be located inside golf club head 100.

In many embodiments, slot 331 can be oriented such that the bottom end of strike portion 110 is located closer to slot base 333 than slot opening 332. In some embodiments, slot 331 also can be oriented such that slot base 333 is located closer to the bottom end of strike portion 110 than slot opening 332. In some embodiments, at least a portion of rear wall 335 and/or front wall 336 can be parallel to strikeface 111. In various embodiments, at least a portion of rear wall 335 and/or front wall 336 can extend in substantially the same direction as strikeface 111. In many embodiments, a distance between strikeface 111 and front wall 336 can be greater at slot base 333 than at slot opening 332, such as shown in FIGS. 3-5, which can advantageously provide increased durability of golf club head 100 on lower portions of strike portion 110. In certain embodiments, at least a portion of rear wall 335 and/or front wall 336 can be parallel to at least a portion of sole 121. In other embodiments, slot 331 can have other suitable orientations within golf club head 100.

Figure 13:
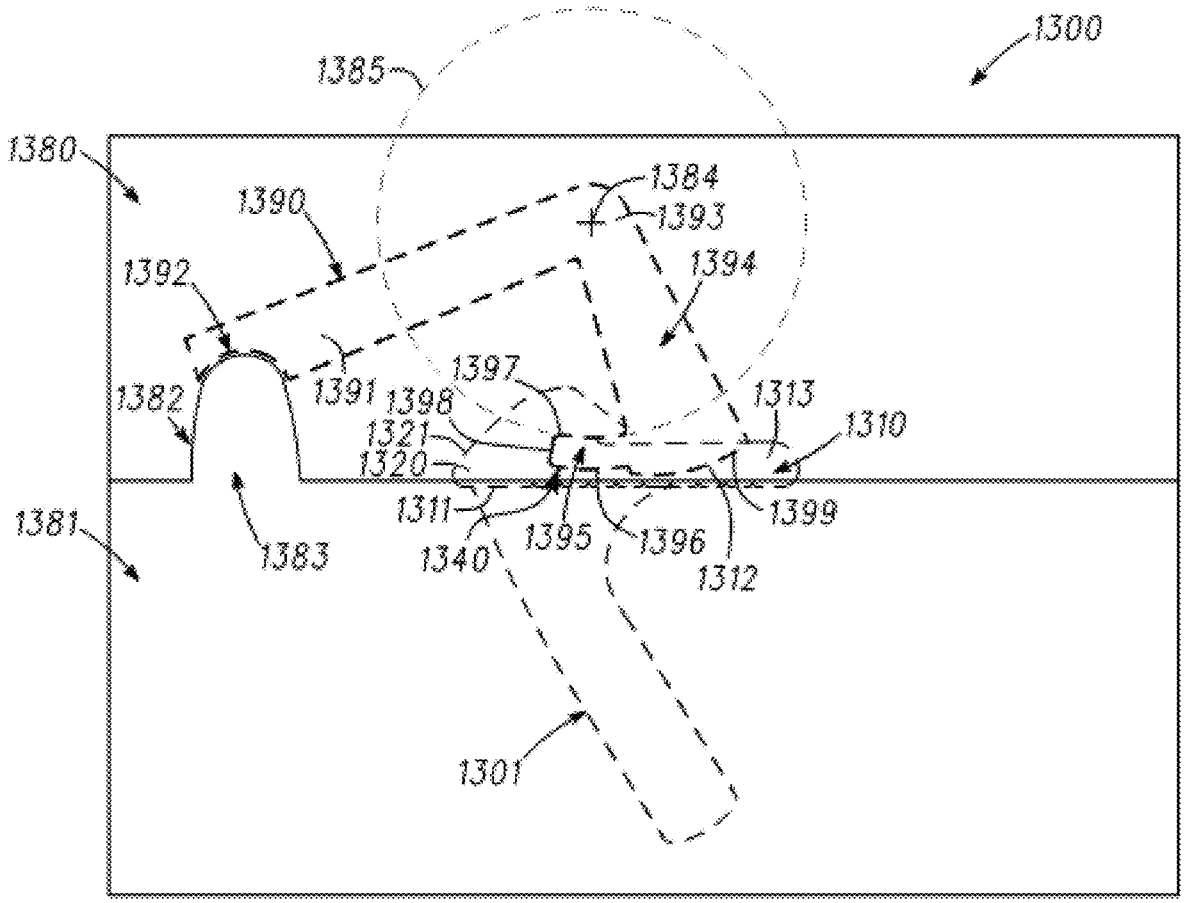
FIG. 13 illustrates a mold in a closed configuration, according to another embodiment.
Figure 14:
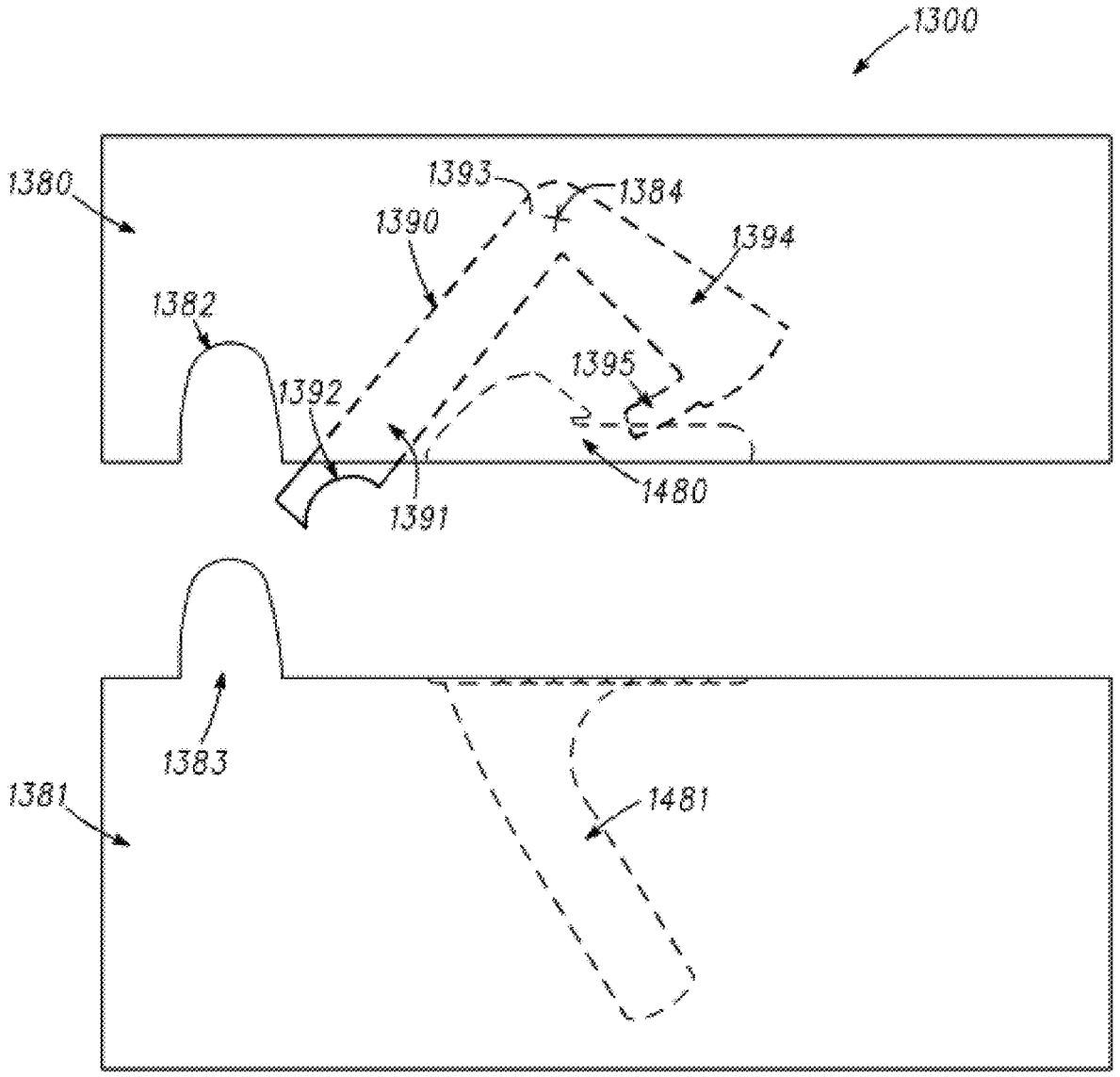
FIG. 14 illustrates the mold of FIG. 13 in an open configuration.

In several embodiments, at least a portion of front wall 336 can be located closer to strikeface 111 than at least a portion of backface 112. In some embodiments, the distance between strikeface 111 and front wall 336 at slot opening 332 can be less than the distance between strikeface 111 and at least a portion of backface 112. For example, the thickness of strike portion 110 at the top of strike portion 110 at perimeter portion 113 can be greater than the distance between strikeface 111 and front wall 336 at slot opening 332. In many embodiments, backface 112 can be at least partially concave. For example, as shown in FIGS. 3-5, backface 112 can curve concavely between perimeter portion 113 and rear portion 120. In some embodiments, the concave curve of backface 112 can be parallel to, or otherwise similar to, the curves of at least one of rear wall 335 or front wall 336. In many embodiments, the concave curve to backface 112 can beneficially facilitate simpler manufacturing of golf club head 100, such that, even when the thickness of strike portion 110 at a portion of backface 112 is greater than the distance between strikeface 111 and front wall 336 at slot opening 332, port structure 330 and/or slot 331 can be cast with a tooling pick piece that can be removed in one motion without interfering with backface 112, such as by simply rotating the tooling pick piece about a fixed point. For example, the tooling pick piece can be similar to tooling piece 1390, as shown in FIGS. 13-14 and described below.

In a number of embodiments, front wall 336 can be curved and have a front wall curve in a second direction perpendicular to the first direction and extending between heel wall 537 and toe wall 334. In other embodiments, front wall 336 can be substantially or approximately straight along the second direction. In several embodiments, rear wall 335 can be curved and have a rear wall curve in the second direction. In other embodiments, rear wall 335 can be substantially or approximately straight along the second direction. The front wall curve and/or rear wall curve in the second direction extending between heel wall 537 and toe wall 334 can at least partially have a circular, elliptical, oval, or other arcuate shape. As an example, as shown in FIGS. 3-5, front wall 336 can be concave in the second direction in slot 331, and rear wall 335 can be substantially or approximately straight in the second direction in slot 331. In some embodiments, front wall 336 can be a shorter distance from rear wall 336 at heel wall 537 and/or at toe wall 334 than at a midpoint between heel wall 537 and toe wall 334. In some embodiments, a majority of front wall 336 and/or rear wall 335 can be substantially curved in the second direction. In various embodiments, a majority of front wall 336 and/or rear wall 335 can be substantially or approximately straight in the second direction.

In many embodiments, port structure 330 can include a cap recess 340 at slot opening 332, which can be configured to receive a cap 661 (as shown in FIGS. 6-8, described below) of tuning element 150 (FIGS. 1-2), as described below in further detail. In many embodiments, cap recess 340 can extend around and beyond front wall 336, rear wall 335, toe wall 334, and/or heel wall 537 at slot opening 332. In some embodiments, cap recess 340 can extend beyond front wall 336 to backface 112. In a number of embodiments, cap recess 340 can circumscribe or otherwise extend beyond slot 331 at slot opening 332 by approximately 0.02 inch (0.0508 cm) to approximately 0.1 inch (0.254 cm) around the entire perimeter of slot 331. For example, cap recess 340 can extend approximately 0.02 inch (0.0508 cm), 0.03 inch (0.0762 cm), 0.04 inch (0.1016 cm), 0.05 inch (0.127 cm), 0.06 inch (0.1524 cm), 0.07 inch (0.1778 cm), 0.08 inch (0.2032 cm), 0.9 inch (0.2286 cm), or any other suitable distance in between those distance values, and can range from any one of those distance values to any other one of those distance values. In some embodiments, for example, cap recess 340 can extend beyond slot 331 at slot opening 332 approximately 0.03 inch (0.0762 cm) to approximately 0.07 inches (0.1778 cm). For example, at least a portion of cap recess 340 can extend beyond slot 331 at slot opening 332 approximately 0.5 inch (2.54 cm), such as shown in FIGS. 3-5. In some embodiments, cap recess 340 can extend beyond slot 331 at slot opening 332 variable or otherwise different distances on one or more sides of slot opening 332. In other embodiments, port structure 330 does not include cap recess 340, such as for a tuning element without a cap.

Turning ahead in the drawings, FIG. 6 illustrates a side view of tuning element 150, according to an embodiment. FIG. 7 illustrates a rear view of tuning element 150. FIG. 8 illustrates a top view of tuning element 150. Tuning element 150 is merely exemplary and embodiments of the tuning element are not limited to the embodiments presented herein. The tuning element can be employed in many different embodiments or examples not specifically depicted or described herein.

In several embodiments, tuning element 150 can be located within and/or be substantially conformal with port structure 330 (FIGS. 3-5). In many embodiments, tuning element 150 can include a main portion 651 and a cap 661. In other embodiments, tuning element 150 can include main portion 651 without cap 661, such as when port structure 330 does not include cap recess 340 (FIGS. 3-5). In certain embodiments, main portion 651 and cap 661 can be made of the same material or materials. In a number of embodiments, main portion 651 can be integral and/or co-molded with cap 661. In other embodiments, main portion 651 can be a separate piece of material fastened to cap 661, such as by welding, brazing, adhering, and/or other mechanical or chemical fasteners. In some embodiments, tuning element 150 can be injection molded, machined, sintered, or made or placed in port structure 330 (FIGS. 3-5) by other suitable processes. In various embodiments, tuning element 150 can be made of the same or different materials than rear portion 120 (FIGS. 1-5) or strike portion 110 (FIGS. 1-5). In certain embodiments, tuning element 150 can be made of one or more elastomers. For example, tuning element 150 can be made of nonferrous thermoplastic urethane, thermoplastic elastomeric polymer(s), hybrid plastics with a mix of ferrous particles or other alloy ferrous particles mixed into polyurethane or other elastomeric polymers. In other embodiments, tuning element 150 can be a metal such as aluminum, steel, tungsten, or other suitable metals, such as when tuning element 150 is sintered or machined.

In many embodiments, tuning element 150 can have a weight that advantageously can be configured to reinforce strike portion 110 (FIGS. 1-5), to beneficially minimize undesirable impact vibration, and/or to establish or adjust the golf club swingweight during assembly. For example, tuning element 150 can have a mass of approximately 1.0 g to approximately 100 g. For example, tuning element 150 can have a mass of approximately 1.0 g, 2.0 g, 3.0 g, 4.0 g, 5.0 g, 6.0 g, 7.0 g, 8.0 g, 9.0 g, 10.0 g, 11.0 g, 12.0 g, 13.0 g, 14.0 g, 15.0 g, 16.0 g, 17.0 g, 18.0 g, 19.0 g, 20.0 g, 21.0 g, 22.0 g, 23.0 g, 24.0 g, 25.0 g, 26.0 g, 27.0 g, 28.0 g, 29.0 g, 30.0 g, 35.0 g, 40.0 g, 45.0 g, 50.0 g, 55.0 g, 60.0 g, 65.0 g, 70.0 g, 75.0 g, 80.0 g, 85.0 g, 90.0 g, 95.0 g, 100.0 g, or any other suitable mass in between those mass values, and can range from any one of those mass values to any other one of those distance values. For example, in some embodiments, tuning element 150 can have a mass of approximately 1.0 g to approximately 30.0 g.

In several embodiments, tuning element 150 can have a density of approximately 1.0 g/cc to approximately 20.0 g/cc. For example, tuning element 150 can have a density of approximately 1.0 g/cc, 1.5 g/cc, 2.0 g/cc, 2.5 g/cc, 3.0 g/cc, 3.5 g/cc, 4.0 g/cc, 4.5 g/cc, 5.0 g/cc, 5.5 g/cc, 6.0 g/cc, 6.5 g/cc, 7.0 g/cc, 7.5 g/cc, 8.0 g/cc, 8.5 g/cc, 9.0 g/cc, 9.5 g/cc, 10.0 g/cc, 10.5 g/cc, 11.0 g/cc, 11.5 g/cc, 12.0 g/cc, 12.5 g/cc, 13.0 g/cc, 13.5 g/cc, 14.0 g/cc, 14.5 g/cc, 15.0 g/cc, 15.5 g/cc, 16.0 g/cc, 16.5 g/cc, 17.0 g/cc, 17.5 g/cc, 18.0 g/cc, 18.5 g/cc, 19.0 g/cc, 19.5 g/cc, 20.0 g/cc, or any other suitable density value in between those density values, and can range from any one of those density values to any other one of those density values. For example, in some embodiments, tuning element 150 can have a density of approximately 1.0 g/cc to approximately 9.0 g/cc. In some embodiments, the density of tuning element 150 can be less than the density of rear portion 120. In other embodiments, the density of tuning element 150 can be greater than or equal to the density of rear portion 120.

In many embodiments, main portion 651 of tuning element 150 can include a tuning element rear side 655, a tuning element front side 656, a tuning element heel side 757, a tuning element toe side 654, and/or a tuning element bottom side 653. The interfaces between tuning element rear side 655, tuning element heel side 757, tuning element front side 656, and tuning element toe side 654 can be angled acutely, orthogonally, or obtusely, or can be rounded. For example, in some embodiments, main portion 651 can be rounded, such that the interfaces between tuning element rear side 655, tuning element heel side 757, tuning element front side 656, and tuning element toe side 654 do not include an angled edge. In a number of embodiments, tuning element heel side 757 can be at an angle of greater than 90 degrees with respect to tuning element rear side 655, and/or tuning element toe side 654 can be at an angle of greater than 90 degrees with respect to tuning element rear side 655, as shown in FIG. 7. In various embodiments, tuning element heel side 757 can be at an angle of less than 90 degrees with respect to tuning element rear side 655, and/or tuning element toe side 654 can be at an angle of less than 90 degrees with respect to tuning element rear side 655. In several embodiments, tuning element heel side 757 can be orthogonal with respect to tuning element rear side 655, and/or tuning element toe side 654 can be orthogonal with respect to tuning element rear side 655.

In a number of embodiments, cap 661 of tuning element 150 can include a cap rear side 665, a cap front side 666, a cap heel side 767, a cap toe side 664, a cap bottom lip 663, and/or a cap top side 668. The interfaces between cap rear side 665, cap heel side 767, cap front side 666, and cap toe side 664 can be angled acutely, orthogonally, or obtusely, or can be rounded. For example, in some embodiments, cap 661 can be rounded, such that the interfaces between cap rear side 665, cap heel side 767, cap front side 666, and cap toe side 664 do not include an angled edge. In a number of embodiments, cap heel side 767 can be at an angle of greater than 90 degrees with respect to cap rear side 665, and/or cap toe side 664 can be at an angle of greater than 90 degrees with respect to cap rear side 665, as shown in FIGS. 7-8. In various embodiments, cap heel side 767 can be at an angle of less than 90 degrees with respect to cap rear side 665, and/or cap toe side 664 can be at an angle of less than 90 degrees with respect to cap rear side 665. In several embodiments, cap heel side 767 can be orthogonal with respect to cap rear side 665, and/or cap toe side 664 can be orthogonal with respect to cap rear side 665. In many embodiments, cap heel side 767 can have the same or similar orientation as tuning element heel side 757, cap toe side 664 can have the same or similar orientation as tuning element toe side 654, cap rear side 665 can have the same or similar orientation as tuning element rear side 655, and/or cap front side 666 can have the same or similar orientation as tuning element front side 656. In some embodiments, cap 661 can be optional on tuning element 150, and/or cap recess 340 (FIGS. 3-5) can be optional on port structure 330 (FIGS. 3-5). For example, tuning element 150 can, in some embodiments, not include cap 661 and can sit flush in port structure 330 (FIGS. 3-5) without port recess 340 (FIGS. 3-5) at slot opening 332 (FIGS. 3-5), or tuning element 150 can protrude slightly from, or be slightly recessed within, slot opening 332 (FIGS. 3-5).

In many embodiments, tuning element 150 or one or more elements of tuning element 150 can have an arcuate shape in one or more directions. For example, tuning element rear side 655 and/or cap rear side 665 can be curved in a first direction extending between cap top side 668 and tuning element bottom side 653. As another example, tuning element front side 656 can be curved in the first direction extending between cap top side 668 and tuning element bottom side 653. In several embodiments, the curves of tuning element rear side 655 and/or tuning element front side 656 in the first direction extending between cap top side 668 and tuning element bottom side 653 can have a circular, elliptical, oval, or other curved shape, and in many embodiments can be matched or correlated with rear wall 335 (FIGS. 3-5) and/or front wall 336 (FIGS. 3-5) of slot 331 (FIGS. 3-5) in the first direction. For example, tuning element rear side 655 can have a radius in the first direction that is similar or identical to the radius 447 (FIG. 4) of circle 445 (FIG. 4), as described above in connection with rear wall 335 (FIGS. 3-5). As another example, tuning element front side 656 can have a radius in the first direction that is similar or identical to radius 448 (FIG. 4) of circle 446 (FIG. 4), as described above in connection with front wall 336 (FIGS. 3-5). In many embodiments, such as shown in FIG. 6, the curves of tuning element rear side 655 and/or tuning element front side 656 extending along the first direction can each be a portion of a circle. In certain embodiments, each circle can be concentric. In a number of embodiments, tuning element front side 656 can be a substantially or approximately constant distance from tuning element rear side 655 when moving along the first direction. In a number of embodiments, such as shown in FIG. 6, tuning element rear side 655 can be concave in the first direction and tuning element front side 656 can be convex in the first direction. In other embodiments, tuning element rear side 655 can be convex in the first direction and tuning element front side 656 can be concave in the first direction.

In a number of embodiments, tuning element front side 656 and/or cap front side 666 can be curved in a second direction perpendicular to the first direction and extending between tuning element heel side 757 and tuning element toe side 654. In other embodiments, tuning element front side 656 and/or cap front side 666 can be substantially or approximately straight along the second direction. In several embodiments, tuning element rear side 655 and/or cap rear side 665 can be curved in the second direction. In other embodiments, tuning element rear side 655 and/or cap rear side 665 can be substantially or approximately straight along the second direction. In a number of embodiments, the curves of tuning element rear side 655 and/or tuning element front side 656 in the second direction extending between extending between tuning element heel side 757 and tuning element toe side 654 can at least partially have a circular, elliptical, oval, or other arcuate shape, and in many embodiments can be matched or correlated with rear wall 335 (FIGS. 3-5) and/or front wall 336 (FIGS. 3-5) of slot 331 (FIGS. 3-5) in the second direction.

In the embodiment shown in FIGS. 6-8, tuning element front side 656 and cap front side 666 are concave in the second direction, and tuning element rear side 655 and cap rear side 665 are substantially or approximately straight in the second direction. In the embodiment presented, tuning element rear side 655 is concave in the first direction, and tuning element front side 656 is convex in the first direction. In the embodiment presented, tuning element 150 has a heel-to-toe length (from cap heel side 767 to cap toe side 664) of approximately 2.5 inches (6.35 cm). In other embodiments, tuning element 150 can have a heel-to-toe length of approximately 0.5 inch (1.27 cm) to approximately 4.0 inches (10.16 cm). For example, tuning element 150 can have a heel-to-toe length of approximately 0.5 inch (1.27 cm), 0.75 inch (1.905 cm), 1.0 inch (2.54 cm), 1.25 inches (3.175 cm), 1.5 inches (3.81 cm), 1.75 inches (4.445 cm), 2.0 inches (5.08 cm), 2.25 inches (5.715 cm), 2.5 inches (6.35 cm), 2.75 inches (6.985 cm), 3.0 inches (7.62 cm), 3.25 inches (8.255 cm), 3.5 inches (8.89 cm), 3.75 inches (9.525 cm), 4.0 inches (10.16 cm), or any other suitable length value in between those length values, and can range from any one of those length values to any other one of those length values. For example, tuning element 150 can have a heel-to-toe length of approximately 1.0 inch (2.54 cm) to approximately 3.0 inches (7.62 cm).

In the embodiment presented, main portion 651 of tuning element 150 has a height (from tuning element bottom side 653 to cap bottom lip 663) of approximately 0.45 inch (1.143 cm). In other embodiments, main portion 651 can have a height of approximately 0.1 inch (0.254 cm) to approximately 1.0 inch (2.54 cm). For example, main portion 651 can have a height of approximately 0.1 inch (0.254 cm), 0.15 inch (0.381 cm), 0.2 inch (0.508 cm), 0.25 inch (0.635 cm), 0.3 inch (0.762 cm), 0.35 inch (0.889 cm), 0.4 inch (1.016 cm), 0.45 inch (1.143 cm), 0.5 inch (1.27 cm), 0.55 inch (1.397 cm), 0.6 inch (1.524 cm), 0.65 inch (1.651 cm), 0.7 inch (1.778 cm), 0.75 inch (1.905 cm), 0.8 inch (2.032 cm), 0.85 inch (2.159 cm), 0.9 inch (2.286 cm), 0.95 inch (2.413 cm), 1.0 inch (2.54 cm), or any other suitable height value in between those height values, and can range from any one of those height values to any other one of those height values. For example, main portion 651 can have a height of approximately 0.1 inch (0.254 cm) to approximately 0.7 inch (1.778 cm).

In the embodiment presented, cap 661 has a height (from cap bottom lip 663 to cap top side 668) of approximately 0.15 inch (0.381 cm). In other embodiments, cap 661 can have a height of approximately 0.02 inch (0.0508 cm) to approximately 1.0 inch (2.54 cm). For example, cap 661 can have a height of approximately 0.02 inch (0.0508 cm), 0.05 inch (0.127 cm), 0.1 inch (0.254 cm), 0.15 inch (0.381 cm), 0.2 inch (0.508 cm), 0.25 inch (0.635 cm), 0.3 inch (0.762 cm), 0.35 inch (0.889 cm), 0.4 inch (1.016 cm), 0.45 inch (1.143 cm), 0.5 inch (1.27 cm), 0.55 inch (1.397 cm), 0.6 inch (1.524 cm), 0.65 inch (1.651 cm), 0.7 inch (1.778 cm), 0.75 inch (1.905 cm), 0.8 inch (2.032 cm), 0.85 inch (2.159 cm), 0.9 inch (2.286 cm), 0.95 inch (2.413 cm), 1.0 inch (2.54 cm), or any other suitable height value in between those height values, and can range from any one of those height values to any other one of those height values. For example, cap 661 can have a height of approximately 0.02 inch (0.0508 cm) to approximately 0.4 inch (1.016 cm).

In the embodiment presented, tuning element has a height (from tuning element bottom side 653 to cap top side 668) of approximately 0.6 inch (1.524 cm). In other embodiments, tuning element 150 can have a height of approximately 0.1 inch (0.254 cm) to approximately 2.0 inches (5.08 cm). For example, tuning element 150 can have a height of approximately 0.1 inch (0.254 cm), 0.15 inch (0.381 cm), 0.2 inch (0.508 cm), 0.25 inch (0.635 cm), 0.3 inch (0.762 cm), 0.35 inch (0.889 cm), 0.4 inch (1.016 cm), 0.45 inch (1.143 cm), 0.5 inch (1.27 cm), 0.55 inch (1.397 cm), 0.6 inch (1.524 cm), 0.65 inch (1.651 cm), 0.7 inch (1.778 cm), 0.75 inch (1.905 cm), 0.8 inch (2.032 cm), 0.85 inch (2.159 cm), 0.9 inch (2.286 cm), 0.95 inch (2.413 cm), 1.0 inch (2.54 cm), 1.05 inches (2.667 cm), 1.1 inches (2.794 cm), 1.15 inches (2.921 cm), 1.2 inches (3.048 cm), 1.25 inches (3.175 cm), 1.3 inches (3.302 cm), 1.35 inches (3.429 cm), 1.4 inches (3.556 cm), 1.45 inches (3.683 cm), 1.5 inches (3.81 cm), 1.55 inches (3.937 cm), 1.6 inches (4.064 cm), 1.65 inches (4.191 cm), 1.7 inches (4.318 cm), 1.75 inches (4.445 cm), 1.8 inches (4.572 cm), 1.85 inches (4.699 cm), 1.9 inches (4.826 cm), 1.95 inches (4.953 cm), 2.0 inches (5.08 cm), or any other suitable height value in between those height values, and can range from any one of those height values to any other one of those height values. For example, tuning element 150 can have a height of approximately 0.1 inch (0.254 cm) to approximately 1.0 inch (2.54 cm).

In the embodiment presented, cap 661 has a front-to-rear thickness (from cap front side 666 to cap rear side 665) of approximately 0.28 inch (0.7112 cm) at a midpoint between cap heel side 767 and cap toe side 664, and main portion 651 has a front-to-rear thickness of approximately 0.22 inch (0.558 cm) at the midpoint between tuning element heel side 757 and tuning element toe side 654, and main portion 651 has a front-to-rear thickness of approximately 0.1 inch (0.254 cm) at tuning element heel side 757 and tuning element toe side 654. In various embodiments, tuning element 150 can have a front-to-rear thickness greater than or equal to approximately 0.025 inch (0.0635), including, for example, at tuning element heel side 757, tuning element toe side 654, cap heel side 767, and/or cap toe side 664. In many embodiments, tuning element 150 can have a front-to-rear thickness of less than or equal to approximately 0.5 inch (1.27 cm), including, for example, at the midpoint between tuning element heel side 757 and tuning element toe side 654. In many embodiments, the front-to-rear thickness of tuning element 150 at tuning element heel side 757, tuning element toe side 654, cap heel side 767, and/or cap toe side 664 can be less than the front-to-rear thickness of tuning element 150 at the midpoint between tuning element heel side 757 and tuning element toe side 654. In other embodiments, the front-to-rear thickness of tuning element 150 can be uniform between running element heel side 757 and tuning element toe side 654. In yet other embodiments, the front-to-rear thickness of tuning element 150 at tuning element heel side 757, tuning element toe side 654, cap heel side 767, and/or cap toe side 664 can be greater than the front-to-rear thickness of tuning element 150 at the midpoint between tuning element heel side 757 and tuning element toe side 654.

In a number of embodiments, cap bottom lip 663 can extend beyond tuning element heel side 757 to cap heel side 767, beyond tuning element toe side 654 to cap toe side 664, beyond tuning element rear side 655 to cap rear side 665, and/or beyond tuning element front side 656 to cap front side 666. In the example shown in FIGS. 6-8, cap bottom lip circumscribes or otherwise extends approximately 0.05 inch (0.127 cm) in one or more directions. In other embodiments, cap bottom lip 663 can extend approximately 0.02 inch (0.0508 cm) to approximately 0.5 inch (0.127 cm) in one or more directions. For example, cap bottom lip 663 can extend approximately 0.02 inch (0.0508 cm), 0.025 inch (0.0635 cm), 0.05 inch (0.127 cm), 0.075 inch (0.1905 cm), 0.1 inch (0.254 cm), 0.125 inch (0.3175 cm), 0.15 inch (0.381 cm), 0.175 inch (0.4445 cm), 0.2 inch (0.508 cm), 0.225 inch (0.5715 cm), 0.25 inch (0.635 cm), 0.275 inch (0.6985 cm), 0.3 inch (0.762 cm), 0.325 inch (0.8255 cm), 0.35 inch (0.889 cm), 0.375 inch (0.9525 cm), 0.4 inch (1.016 cm), 0.425 inch (1.0795 cm), 0.45 inch (1.143 cm), 0.475 inch (1.2065 cm), 0.5 inch (1.27 cm), or any other suitable length value in between those length values, and can range from any one of those length values to any other one of those length values. In many embodiments, cap bottom lip 663 can extend different dimensions in two or more directions.

Figure 9:
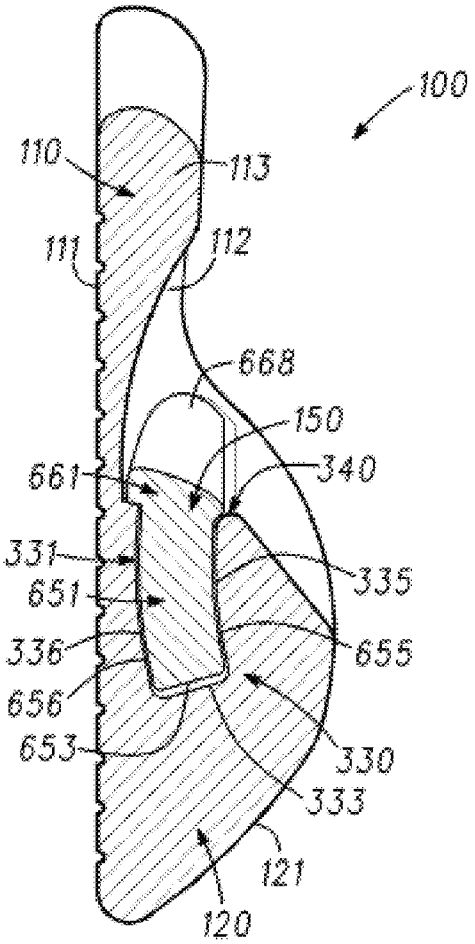
FIG. 9 illustrates a side cross-sectional view along line 3-3 in FIG. 2 of the golf club head of FIG. 1 with the tuning element of FIG. 1.
Figure 10:
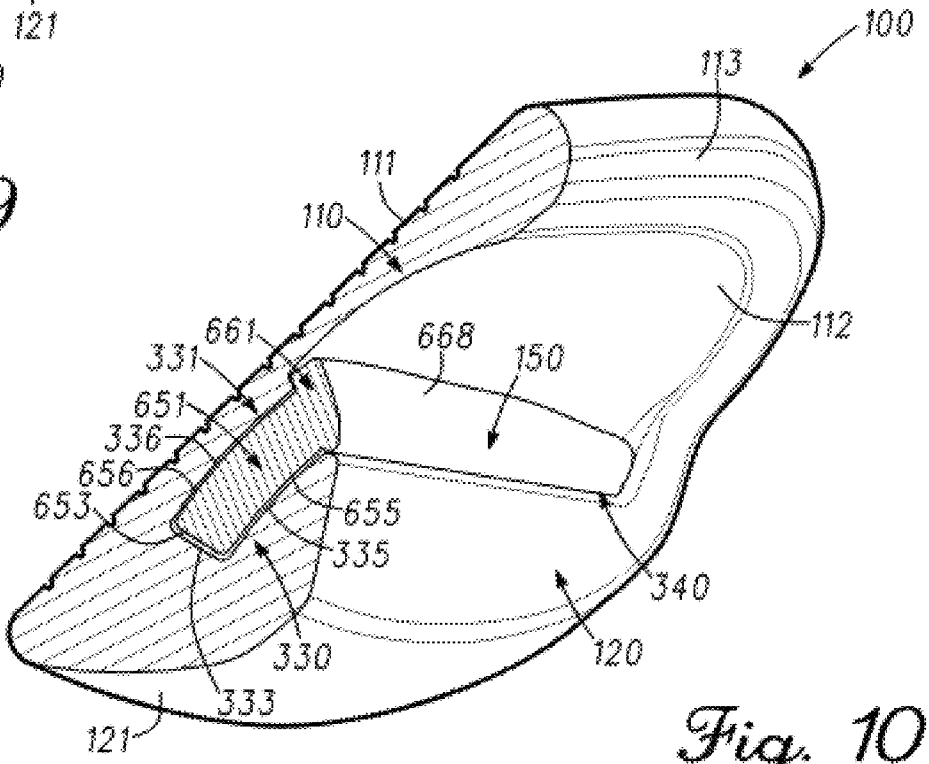
FIG. 10 illustrates a side, bottom, rear perspective cross-sectional view along line 3-3 in FIG. 2 of the golf club head of FIG. 1 with the tuning element of FIG. 1.

Turning ahead in the drawings, FIG. 9 illustrates a side cross-sectional view along line 3-3 in FIG. 2 of golf club head 100 with tuning element 150. FIG. 10 illustrates a side, bottom, rear perspective cross-sectional view along line 3-3 in FIG. 2 of golf club head 100 with tuning element 150. As shown in FIGS. 9-10, port structure 330 can be configured to receive and/or secure tuning element 150. Main portion 651 can fit within and/or be substantially conformal with slot 331, and/or cap 661 can fit within cap recess 340. In a number of embodiments, port structure 330 can be slightly larger than tuning element 150 to allow tuning element 150 to be inserted within port structure 330. Tuning element 150 can be adhered or otherwise affixed to port structure 330. For example, tuning element 150 can be secured within port structure using an adhesive, such as an epoxy. In certain embodiments, the epoxy can have a thickness of at least approximately 0.001 inch (0.00254 cm), and port structure 330 can be at least approximately 0.001 inch (0.00254 cm) larger than tuning element 150 in one or more directions. For example, port structure can be approximately 0.01 inch (0.0254 cm) larger than tuning element 150 in each direction. In the embodiment shown in FIGS. 9 and 10, a larger gap can exist between tuning element bottom side 653 and slot base 333 than between other parts of tuning element 150 and port structure 330. This gap can be used to hold excess amounts of the adhesive so that the adhesive does not overflow out of slot 331 or port structure 330. In other embodiments, tuning element 150 (with or without cap 661) can be held in port structure 330 using mechanical mechanisms, such as snaps, ribs, fasteners, or other suitable mechanical mechanisms.

In many embodiments, when tuning element 150 is seated within port structure 330, tuning element toe side 654 (FIGS. 6-7) can interface with toe wall 334 (FIGS. 3-4), tuning element heel side 757 (FIG. 7) can interface with heel wall 537 (FIG. 5), tuning element rear side 655 can interface with rear wall 335, tuning element front side 656 can interface with front wall 336, and/or tuning element bottom side 653 can interface with slot base 333. In a number of embodiments, when tuning element 150 is seated within port structure 330, cap 661 can extend beyond slot 331 and be seated within cap recess 340 at slot opening 332 (FIGS. 3-5) extending beyond front wall 336, rear wall 335, heel wall 537 (FIG. 5), and/or toe wall 334 (FIGS. 3-4).

In various embodiments, cap 661 can fit within cap recess 340, and/or cap top side 668 can be shaped so as to conform to the surrounding shape of rear portion 120 and/or backface 112. For example, cap top side 668 can include one or more curves or angled surfaces. In some embodiments, an appliqué can be added over cap top side 668, rear portion 120, backface 112 and/or the interfaces between cap top side 668, rear portion 120, and/or backface 112, such that rear portion 120, cap top side 668, backface 112, and/or the interfaces thereof can appear seamless, and/or such that the presence of tuning element 150 within golf club head 100 can be partially or fully concealed. In some embodiments, the appliqué can cover cap top side 668 and wrap around the sides of cap 661 to cover at least a portion of all of cap front side 666 (FIGS. 6, 8), cap rear side 665 (FIGS. 6-8), cap toe side 664 (FIGS. 6-8) and/or cap heel side 767 (FIGS. 7-8), so that the edges of the appliqué are hidden from view when cap 661 is located within cap recess 340. In some embodiments, cap recess 340 can be at least approximately 0.01 inch (0.0254 cm) larger than cap 661 in one or more directions. For example, cap recess 340 can be approximately 0.03 inch (0.0762 cm) larger than cap 661 in each direction.

In several embodiments, the shape of port structure 330 and/or tuning element 150 can be such that tuning element 150 can be inserted and/or fit within port structure 330 in only one orientation, which can advantageously prevent tuning element 150 from inadvertently being inserted incorrectly during assembly. For example, the arcuate shape of tuning element 150, port structure 330, and/or one or more elements thereof in one or more directions, and/or the shape of cap 661 and/or cap recess 661 can be configured such that tuning element 150 can fit with port structure 330 in only one orientation.

In various embodiments, the shape of port structure 330 and/or tuning element 150 can be configured so as to increase the surface area of contact between port structure 330 and tuning element 150, which can beneficially increase the bond strength of adhesives securing tuning element 150 to port structure 330 and prevent tuning element 150 from dislodging from port structure 330. For example, in certain embodiments, the height of tuning element 150 can be greater than the front-to-rear thickness of tuning element 150, and/or the distance from slot opening 332 to slot base 333 can be greater than the distance from front wall 336 to rear wall 335. In the embodiment shown, port structure 330 has a surface area of approximately 2.4 square inches ($in^2$) (15.48 square cm ($cm^2$). In other embodiments, port structure 330 can have a surface area of approximately 0.5 $in^2$ (3.23 $cm^2$) to approximately 5.5 $in^2$ (35.48 $cm^2$). For example, port structure 330 can have a surface are of approximately 0.5 $in^2$ (3.23 $cm^2$), 0.75 $in^2$ (4.84 $cm^2$), 1.0 $in^2$ (6.45 $cm^2$), 1.25 $in^2$ (8.06 $cm^2$), 1.5 $in^2$ (9.68 $cm^2$), 1.75 $in^2$ (11.29 $cm^2$), 2.0 $in^2$ (13.90 $cm^2$), 2.25 $in^2$ (14.52 $cm^2$), 2.5 $in^2$ (16.13 $cm^2$), 2.75 $in^2$ (17.74 $cm^2$), 3.0 $in^2$ (19.35 $cm^2$), 3.25 $in^2$ (20.97 $cm^2$), 3.5 $in^2$ (22.58 $cm^2$), 3.75 $in^2$ (24.19 $cm^2$), 4.0 $in^2$ (25.81 $cm^2$), 4.25 $in^2$ (27.42 $cm^2$), 4.5 $in^2$ (29.03 $cm^2$), 4.75 $in^2$ (30.65 $cm^2$), 5.0 $in^2$ (32.26 $cm^2$), 5.25 $in^2$ (33.87 $cm^2$), 5.5 $in^2$ (35.48 $cm^2$), or any other suitable surface area value in between those surface area values, and can range from any one of those surface area values to any other one of those surface area values. In many embodiments, the surfaces of tuning element 150 in contact with port structure 330 can have a similar or identical surface area as port structure 330.

In the embodiment shown, port structure 330 has a volume of approximately 3.3 cc. In other embodiments port structure 330 can have a volume of approximately 0.8 cc to approximately 16.0 cc. For example, port structure 330 can have a volume of approximately 0.8 cc, 1.0 cc, 1.25 cc, 1.5 cc, 1.75 cc, 2.0 cc, 2.25 cc, 2.5 cc, 2.75 cc, 3.0 cc, 3.25 cc, 3.5 cc, 3.75 cc, 4.0 cc, 4.25 cc, 4.5 cc, 4.75 cc, 5.0 cc, 5.25 cc, 5.5 cc, 5.75 cc, 6.0 cc, 6.25 cc, 6.5 cc, 6.75 cc, 7.0 cc, 7.25 cc, 7.5 cc, 7.75 cc, 8.0 cc, 8.25 cc, 8.5 cc, 8.75 cc, 9.0 cc, 9.25 cc, 9.5 cc, 9.75 cc, 10.0 cc, 10.25 cc, 10.5 cc, 10.75 cc, 11.0 cc, 11.25 cc, 11.5 cc, 11.75 cc, 12.0 cc, 12.25 cc, 12.5 cc, 12.75 cc, 13.0 cc, 13.25 cc, 13.5 cc, 13.75 cc, 14.0 cc, 14.25 cc, 14.5 cc, 14.75 cc, 15.0 cc, 15.25 cc, 15.5 cc, 15.75 cc, 16.0 cc, or any other suitable volume value in between those volume values, and can range from any one of those volume values to any other one of those volume values. In many embodiments, tuning element 150 can have a similar or identical volume as port structure 330.

Figure 11:
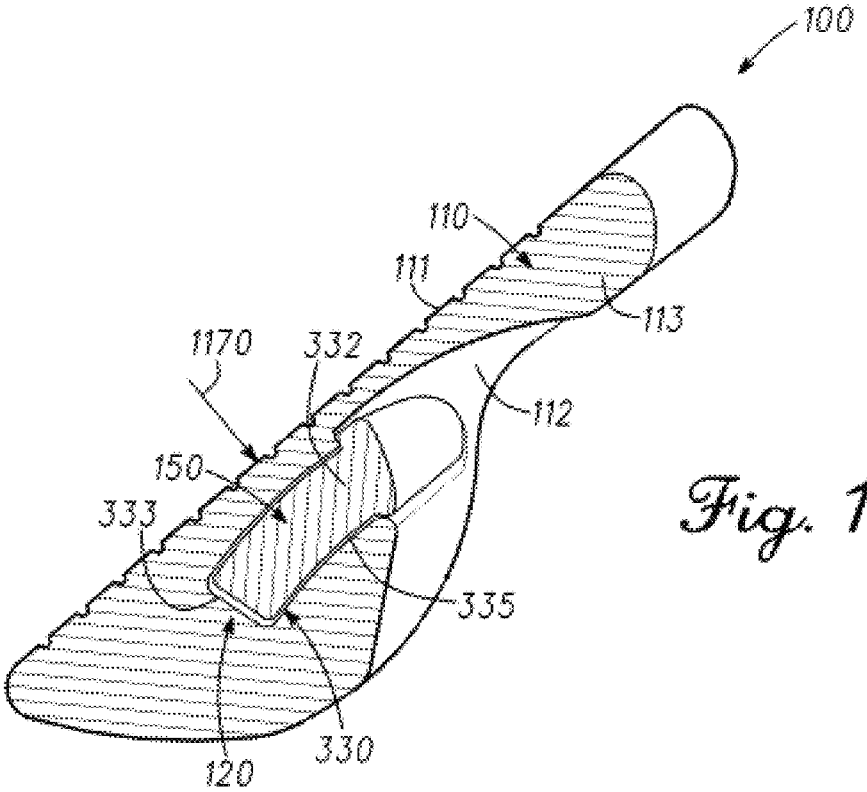
FIG. 11 illustrates a side cross-sectional view along line 3-3 in FIG. 2 of the golf club head of FIG. 1 with the tuning element of FIG. 1 and showing a force normal line upon impact.

Turning ahead in the drawings, FIG. 11 illustrates a side cross-sectional view along line 3-3 in FIG. 2 of golf club head 100 with tuning element 150 and showing a force normal line 1170 upon impact. In many embodiments, the shape, configuration, and/or orientation of tuning element 150 and/or port structure 330 in golf club head 100 can be such that, upon the impact of golf club head 100 with a golf ball, the forces upon tuning element 150, as shown by force normal line 1170, can more uniformly distribute and/or balance the forces pushing tuning element 150 out of port structure 330 and the forces pushing tuning element 150 into port structure 330, as compared to various other conventional tuning port structures, which can naturally force the tuning element out of the tuning port structure. For example, in some embodiments, a center portion of rear wall 335 can be orthogonal with normal force line 1170 and can be convex, such that a bottom portion of rear wall 335 can direct the impact forces on tuning element 150 toward slot base 333, and a top portion of rear wall 335 can direct the impact forces on tuning element 150 toward slot opening 332. The configuration of tuning element 150 and/or port structure 330 can beneficially prevent tuning element 150 from becoming inadvertently dislodged from port structure 330.

Figure 12:
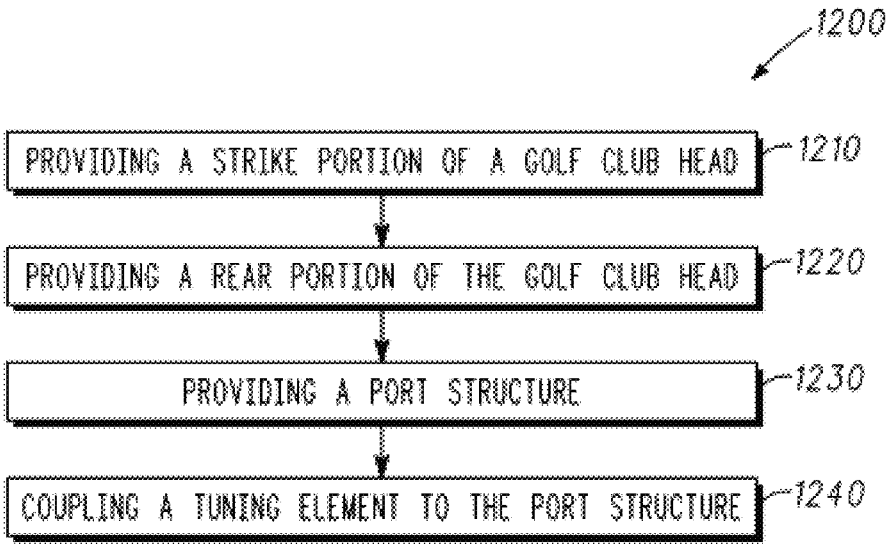
FIG. 12 illustrates a flow chart for a method of providing a golf club head, according to another embodiment.
Figure 18:
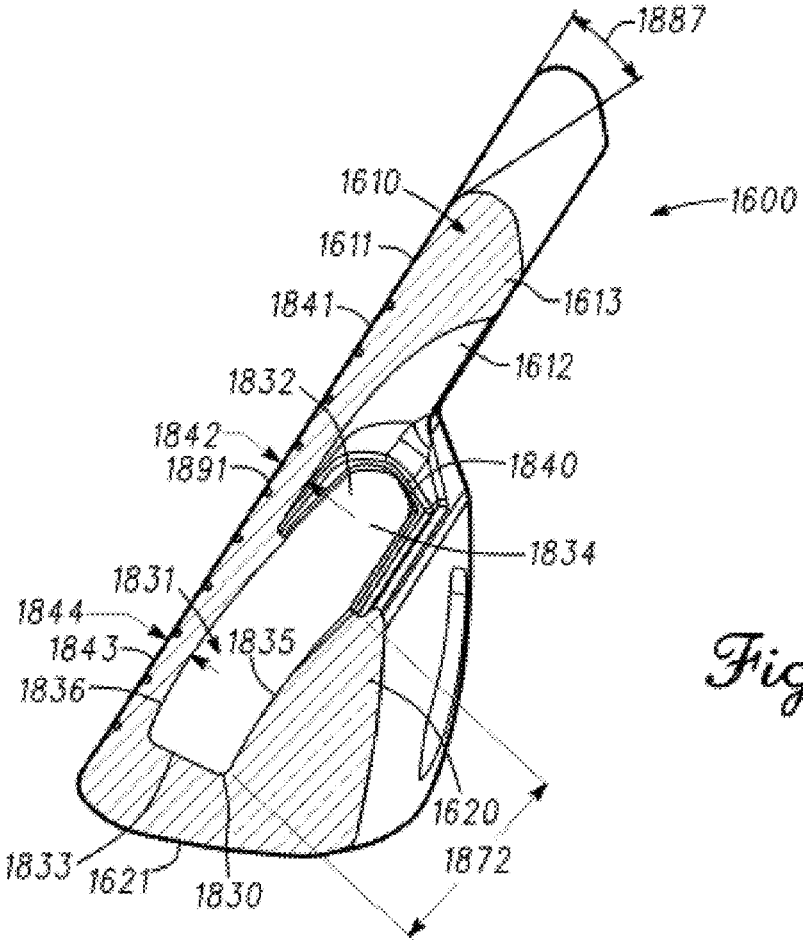
FIG. 18 illustrates a side cross-sectional view of the golf club head of FIG. 16, where the cross-sectional view is taken along cross-sectional line 18-18 in FIG. 17 and the golf club head in FIG. 18 is without the insert of FIG. 16.
Figure 19:
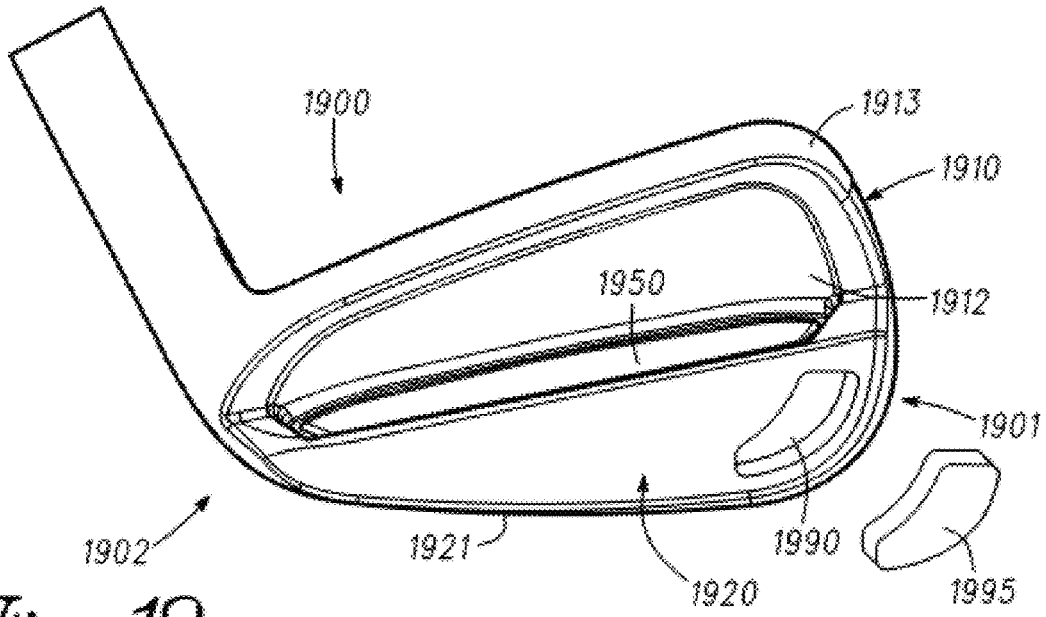
FIG. 19 illustrates a bottom, rear view of a golf club head with an insert, according to still yet another embodiment.

Turning ahead in the drawings, FIG. 12 illustrates a flow chart for a method 1200, which can be used to provide, form, and/or manufacture a golf club head and/or a golf club in accordance with the present disclosure. Method 1200 is merely exemplary and is not limited to the embodiments presented herein. Method 1200 can be employed in many different embodiments or examples not specifically depicted or described herein. In some embodiments, the procedures, the processes, and/or the activities of method 1200 can be performed in the order presented. In other embodiments, the procedures, the processes, and/or the activities of method 1200 can be performed in any suitable order. In still other embodiments, one or more of the procedures, the processes, and/or the activities of method 1200 can be combined or skipped. In some examples, the golf club head can be similar to golf club head 100 (FIGS. 1-5, 9-11), golf club head 1600 (FIGS. 16-18 and 20), and/or golf club head 1900 (FIG. 19).

Referring to FIG. 12, method 1200 can include block 1210 for providing a strike portion of a golf club head. In some examples, the strike portion can be similar to strike portion 110 (FIGS. 1-5, 9-11), strike portion 1610 (FIGS. 16-18 and 20), and/or strike portion 1920 (FIG. 19). The strike portion can include a strikeface, which can be similar or identical to strikeface 111 (FIGS. 1-5, 9-11), strikeface 1611 (FIGS. 16-18 and 20), and/or strikeface 1911 (FIG. 19). The strike portion can include a backface, which can be similar or identical to backface 112 (FIGS. 1-5, 9-11). The backface can be opposite the strikeface. The backface can include a perimeter portion at a top end of the backface. The perimeter portion can be similar or identical to perimeter portion 113 (FIGS. 1-5, 9-11). The strike portion can be provided via casting, forging, milling, machining, molding, and/or other processes, where the strike portion can be a single piece or can include several pieces coupled together such as via welding, brazing, and/or adhesives.

Method 1200 also can include block 1220 for providing a rear portion of the golf club head. In some embodiments, the rear portion can be similar or identical to rear portion 120 (FIGS. 1-5, 9-11), rear portion 1620 (FIG. 16), and/or rear portion 1920 (FIG. 19). The rear portion can be provided via casting, forging, milling, machining, molding, and/or other processes, where the rear portion can be a single piece or can include several pieces coupled together such as via welding, brazing, and/or adhesives. The rear portion can be coupled to the strike portion at a bottom end of the strike portion, such as by welding, brazing, adhering, and/or other mechanical or chemical fasteners. In other embodiments, the rear portion can be integrally formed with the strike portion, such as by being cast as a single piece of material. In these other embodiments, blocks 1210 and 1220 can be performed simultaneously with each other. In these other embodiments, the strikeface can be formed simultaneously with the rest of the strike portion, or the strikeface can be formed separately from the rest of the strike portion and the subsequently coupled to the rest of the strike portion.

Figure 20:
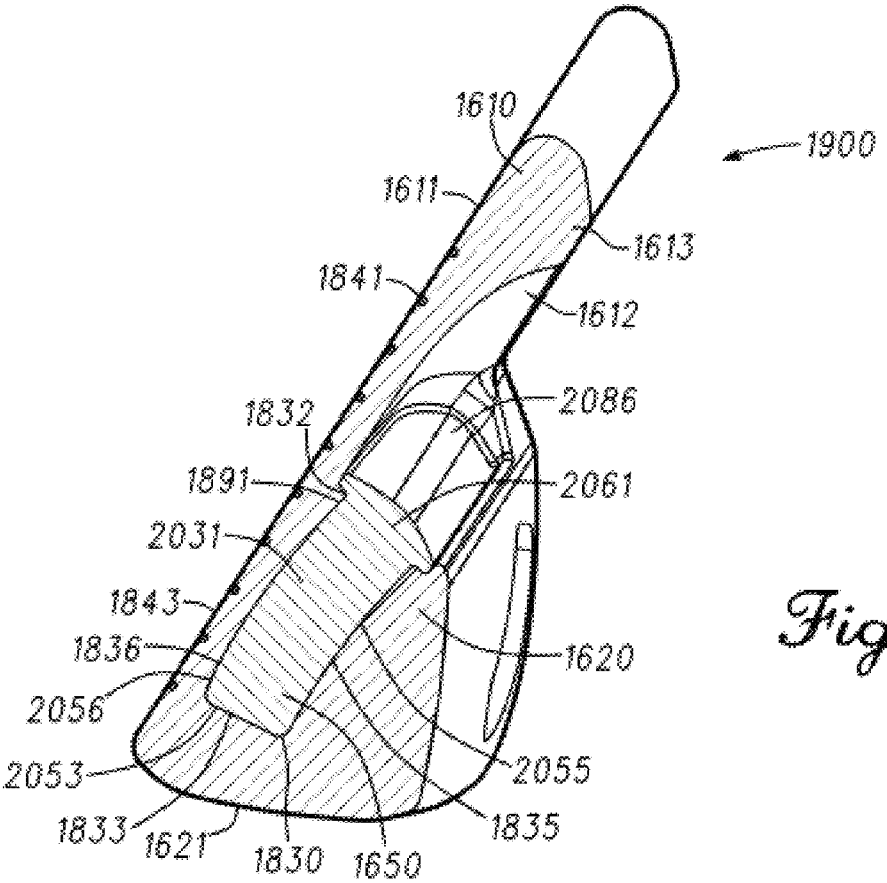
FIG. 20 illustrates a side cross-sectional view of the golf club head of FIG. 16, where the cross-sectional view is taken along cross-sectional line 18-18 in FIG. 17 and the golf club head in FIG. 18 is with the insert of FIG. 16.
Figure 21:
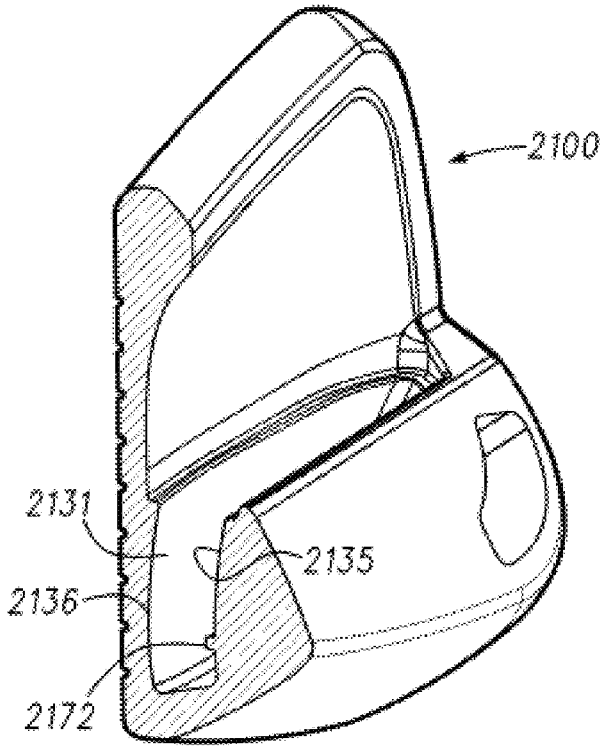
FIG. 21 illustrates a cross-sectional view of a golf club head with an insert, according to yet another embodiment.
Figure 24:
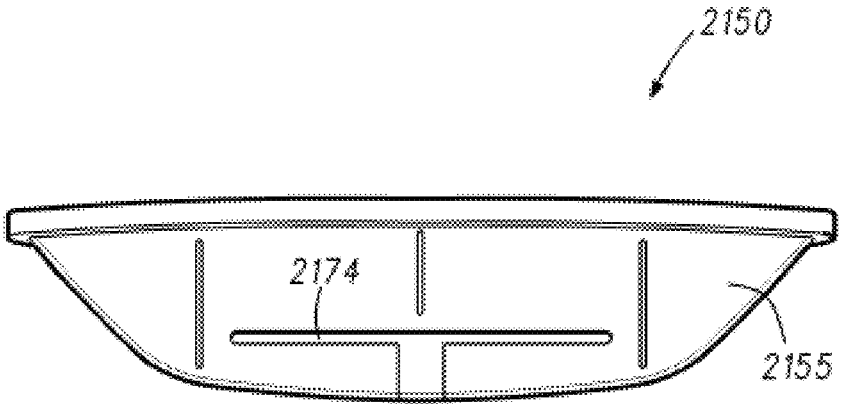
FIG. 24 illustrates a cross-sectional view of the insert of FIG. 21.

Method 1200 also can include block 1230 for providing a port structure. The port structure can be similar or identical to port structure 330 (FIGS. 3-5, 9-11), port structure 1830 (FIGS. 18 and 20). The port structure can be provided via casting, forging, milling, machining, molding, tooling, and/or other processes, where the port structure can be a single piece or can include several pieces coupled together such as via welding, brazing, and/or adhesives. In some examples, the port structure and/or elements thereof can be cast with a tooling pick piece that can be removed in one motion without interfering with the backface by rotating the tooling pick piece about a fixed point, as shown in FIGS. 13-14 and described below. In many embodiments, the concave curve to the backface can beneficially facilitate simpler manufacturing of the golf club head, such that, even when the thickness of the strike portion at a portion of the backface is greater than the distance between the strikeface and the front wall at the slot opening, the port structure and/or the slot can be cast with a tooling pick piece that can be removed in one motion without interfering with the backface, such as by simply rotating the tooling pick piece about a fixed point. In some embodiments, the tooling pick piece can be rotated and removed manually after the mold is opened. In other embodiments, the tooling pick piece can be rotated and removed automatically as the mold is opened. The port structure can be at least partially defined within the rear portion and/or the strike portion, and in many embodiments can be integrally formed with the rear portion and/or the strike portion. Accordingly, block 1230 can be performed simultaneously with block 1210 and/or 1220.

The port structure of block 1230 can include a slot, which can be similar or identical to slot 331 (FIGS. 3-5, 9-10) and/or slot 1831 (FIGS. 18 and 20). The slot can extend from a slot opening, such as slot opening 332 (FIGS. 3-5, 11) and/or slot opening 1832 (FIGS. 18 and 20), to a slot base, such as slot base 333 (FIGS. 3-5, 9-11), and/or slot base 1833 (FIGS. 18 and 20). The slot base can be located closer to the bottom end of the strike portion than the slot opening, and/or the bottom end of the strike portion can be located closer to the slot base than the slot opening. The slot can include a heel wall, such as heel wall 537 (FIG. 5), and a toe wall, such as toe wall 334 (FIGS. 3-4) and/or toe wall 1834 (FIG. 18). The slot can include a rear wall, such as rear wall 335 (FIGS. 3-5, 9-11) and/or rear wall 1835 (FIGS. 18 and 20), which can extend from the slot opening to the slot base, and/or can extend between the heel wall to the toe wall. The rear wall can include a rear wall curve along a first direction extending between the slot opening and the slot base. The slot can include a front wall, such as front wall 336 (FIGS. 3-5, 9-10) and/or front wall 1836 (FIGS. 18 and 20), which can extend from the slot opening to the slot base, and/or can extend between the heel wall to the toe wall. The front wall can be located closer to the strikeface than the rear wall, and/or the strikeface can be located closer to the front wall than the rear wall. The front wall can include a front wall curve along a first direction extending between the slot opening and the slot base.

Method 1200 also can include block 1240 for coupling a tuning element and/or an insert to the port structure. The tuning element can be similar or identical to tuning element 150 (FIGS. 1-2, 6-11), insert 1650 (FIGS. 16-17 and 20), and/or insert 1950 (FIG. 19). In some examples, one or more elements of the tuning element can be coupled to one or more elements of the port structure, such as described above. For example, the tuning element can be inserted in the port structure by rotating the tuning element about a fixed point. The tuning element can be maintained at the secured position via one or more mechanisms, such as friction forces, adhesives between the tuning element and the port structure, and/or mechanical fasteners attaching the tuning element to the port structure. In the same or other examples, the tuning element can be removable from the secured position in the port structure, and/or can be interchangeable with one or more other tuning elements, such as, for example, tuning elements having different densities.

In some examples, one or more of the different blocks of method 1200 can be combined into a single block or performed simultaneously, and/or the sequence of such blocks can be changed. For example, as indicated above, blocks 1210, 1220, and/or 1230 can be combined or performed simultaneously in some embodiments. In the same or other embodiments, some of the blocks of method 1200 can be subdivided into several sub-blocks. For example, block 1240 can be subdivided into a sub-block for molding or otherwise providing the tuning element, a sub-block for coupling an appliqué to the tuning element, a sub-block for inserting the tuning element into the port structure, and/or another sub-block for securing the tuning element into the port structure. There can also be examples where method 1200 can comprise further or different blocks. As an example, method 1200 can comprise a block for providing or coupling a golf club shaft to the golf club head. In addition, there can be examples where method 1200 can comprise only part of the blocks described above. For example, block 1240 can be optional in some implementations, such as in situations where the tuning element is not needed or desired, or in situations in which the decision of whether to couple a tuning element to the port structure is left up to a player or the end user. Other variations can be implemented for method 1200 without departing from the scope of the present disclosure.

Turning ahead in the drawings, FIG. 13 illustrates a mold 1300 in a closed configuration. FIG. 14 illustrates mold 1300 in an open configuration. Mold 1300 is merely exemplary and embodiments of the mold are not limited to the embodiments presented herein. The mold can be employed in many different embodiments or examples not specifically depicted or described herein. In many embodiments, mold 1300 can include a first mold piece 1380 and a second mold piece 1381. In a number of embodiments, first mold piece can include a first cavity portion 1480 (FIG. 14), and/or second mold piece 1381 can include a second cavity portion 1481 (FIG. 14). In many embodiments, mold 1300 can be closed to a closed configuration, as shown in FIG. 13, such that first mold piece 1381 and second mold piece 1382 surround first cavity portion 1480 (FIG. 14) and second cavity portion 1481 (FIG. 14) to allow for injection molding of a golf club head mold 1301 in first cavity portion 1480 and second cavity portion 1481. In a number of embodiments, mold 1300 can be opened to an open configuration, as shown in FIG. 14, such that golf club head mold 1301 (FIG. 13) can be removed from first cavity portion 1480 and second cavity portion 1481.

In several embodiments, golf club head mold 1301 can be made of wax or another suitable material through injection molding, which can be used for investment casting to form golf club head 100 (FIGS. 1-5, 9-11), golf club head 1600 (FIGS. 16-18 and 20), and/or golf club head 1900 (FIG. 19). In many embodiments, the shape of golf club head mold 1301 can be similar or identical to the shape of golf club head 100 (FIGS. 1-5, 9-11), golf club head 1600 (FIGS. 16-18 and 20), and/or golf club head 1900 (FIG. 19). For example, golf club head mold 1301 can include a strike portion 1310, a strikeface 1311, a backface 1312, a perimeter portion 1313, a rear portion 1320, a sole 1321. Strike portion 1310 can be similar or identical in shape to strike portion 110 (FIGS. 1-5, 9-11); strikeface 1311 can be similar or identical in shape to strikeface 111 (FIGS. 1, 3-5, 9-11); backface 1312 can be similar or identical in shape to backface 112 (FIGS. 1-5, 9-11); perimeter portion 1313 can be similar or identical in shape to perimeter portion 113 (FIGS. 1-5, 9-11); rear portion 1320 can be similar or identical to rear portion 120 (FIGS. 1-5, 9-11); and/or sole 1321 can be similar or identical to sole 121 (FIGS. 1-5, 9-10). In many embodiments, golf club head mold 1301 can include a port structure 1336, which can be similar or identical in shape to port structure 330 (FIGS. 3-5, 9-11).

In some embodiments, first mold piece 1380 can include a tooling piece 1390. In many embodiments, tooling piece 1390 can include a first arm 1391 and a second arm 1394 connected together at a hub 1393. In several embodiments, tooling piece 1390 can be rotationally attached to first mold piece 1380 at a rotation point 1384 on hub 1393. In some embodiments, tooling piece 1390 can be rotated between a mold position, as shown in FIG. 13 and a release position, as shown in FIG. 14. In many embodiments, tooling piece 1390 can include a mold portion 1395 attached to second arm 1394. Mold portion 1395 can include one or more surfaces, which, along with the surfaces of first cavity portion 1480 (FIG. 14) and second cavity portion 1481 (FIG. 14), can provide mold surfaces for the injection molding of golf club head mold 1301 when mold 1300 is in the closed configuration and tooling piece 1390 is in the mold position, as shown in FIG. 13. In many embodiments, for example, mold portion 1395 can include a rear tooling surface 1397, a base tooling surface 1398, a front tooling surface 1396, and/or a backface tooling surface 1399. For example, as shown in FIG. 13, rear tooling surface 1397, base tooling surface 1398, and/or front tooling surface 1396 can be used to mold port structure 1336, and/or backface tooling surface 1399 can be used to mold backface 1312.

In a number of embodiments, second mold piece 1381 can include a protrusion 1383. In some embodiments, first mold piece 1380 can include a recess 1382, which can be configured to receive protrusion 1383. In several embodiments, arm 1391 of tooling piece 1390 can include a surface 1392, which can be configured to engage with protrusion 1383 to rotate tooling piece 1390 around rotation point 1384. In many embodiments, tooling piece 1390 can be spring-loaded to be biased to the release position, as shown in FIG. 14. In several embodiments, when second mold piece 1381 is moved toward first mold piece 1380 so as to close mold 1300, as shown in FIG. 13, protrusion 1383 can press on surface 1392 to rotate tooling piece 1390 clockwise to the mold position, as shown in FIG. 13. In a number of embodiments, mold portion 1395 of tooling piece 1390 can be rotated around rotation point 1384 along a portion of circle 1385 centered at rotation point 1384. For example, rear tooling surface 1397 can rotate along a portion of circle 1385. In several embodiments, mold 1300 can be opened, which can allow tooling piece 1390 to automatically rotate back to the release position, as shown in FIG. 14, when tooling piece 1390 is biased in the release position.

In many embodiments, when tooling piece 1390 is in the mold position and mold 1300 is in the closed configuration, as shown in FIG. 13, the surfaces of first cavity portion 1480 and second cavity portion 1481, along with mold portion 1395 can provide molding surfaces for injection molding of golf club head mold 1301. Once golf club head mold 1301 is formed, tooling piece 1390 can automatically rotate back to the release position as mold 1300 is opened, as shown in FIG. 14. When tooling piece 1390 is rotated back to the release position upon mold 1300 being opened, as shown in FIG. 14, mold portion 1395 can be automatically removed from port structure 1336 of golf club head mold 1301, which can beneficially allow golf club head mold 1301 to be removed from mold 1300 in a single motion after the injection molding of golf club head mold 1301. For example, as mold 1300 is opened by second mold piece 1381 being pulled apart from first mold piece 1380, or vice versa, the spring-loaded bias of tooling piece 1390 can result in surface 1392 following protrusion 1383 such that tooling piece 1390 can be rotated counter-clockwise around rotation point 1384, and mold portion 1395 can automatically disengage from port structure 1336 of golf club head mold 1301 at the same time that golf club head mold 1301 is removed from mold 1300.

Figure 15:
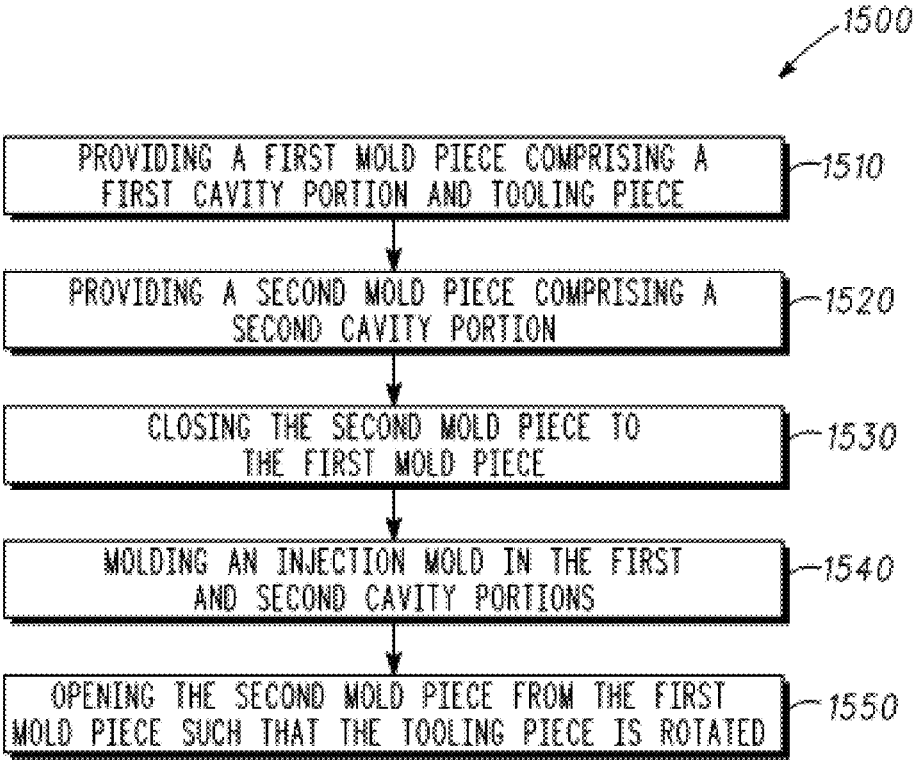
FIG. 15 illustrates a flow chart for a method of forming a golf club head, according to another embodiment.

Turning ahead in the drawings, FIG. 15 illustrates a flow chart for a method 1500 of forming a golf club head, according to various embodiments. Method 1500 is merely exemplary and is not limited to the embodiments presented herein. Method 1500 can be employed in many different embodiments or examples not specifically depicted or described herein. In some embodiments, the procedures, the processes, and/or the activities of method 1500 can be performed in the order presented. In other embodiments, the procedures, the processes, and/or the activities of method 1500 can be performed in any suitable order. In still other embodiments, one or more of the procedures, the processes, and/or the activities of method 1500 can be combined or skipped. In some examples, the golf club head can be similar to golf club head 100 (FIGS. 1-5, 9-11), golf club head 1600 (FIGS. 16-18 and 20), and/or golf club head 1900 (FIG. 19).

Referring to FIG. 15, in some embodiments, method 1500 can include a block 1510 of providing a first mold piece comprising a first cavity portion and a tooling piece. The first mold piece can be similar or identical to first mold piece 1380 (FIGS. 13-14). The first cavity portion can be similar or identical to first cavity portion 1480 (FIG. 14). The tooling piece can be similar or identical to tooling piece 1390 (FIGS. 13-14). In a number of embodiments, the tooling piece can be configured to rotate with respect to the first mold piece about a fixed point on the first mold piece from a mold position to a release position. The fixed point can be similar or identical to rotation point 1384 (FIGS. 13-14). The mold position can be similar or identical to the position of tooling piece 1390 shown in FIG. 13. The release position can be similar or identical to the position of tooling piece 1390 shown in FIG. 14.

In several embodiments, method 1500 also can include a block 1520 of providing a second mold piece comprising a second cavity portion. The second mold piece can be similar or identical to second mold piece 1381 (FIGS. 13-14). The second cavity portion can be similar or identical to second cavity portion 1481 (FIG. 14).

In a number of embodiments, method 1500 further can include a block 1530 of closing the second mold piece to the first mold piece, or vice versa, such that the first and second mold pieces surround the first and second cavity portions, the tooling piece is in the mold position, and a portion of the tooling piece is inserted into at least the first cavity portion. For example, the second mold piece can be closed to the first mold piece as second mold piece 1381 is closed to first mold piece 1380 in FIG. 13. The portion of the tooling piece can be similar to mold portion 1395 (FIGS. 13-14) or portions thereof, such as rear tooling surface 1397 (FIG. 13), base tooling surface 1398 (FIG. 13), front tooling surface 1396 (FIG. 13), and/or backface tooling surface 1399 (FIG. 13).

In several embodiments, method 1500 additionally can include a block 1540 of molding an injection mold in the first and second cavity portions. The injection mold can include a golf club head mold. The golf club head mold can be similar or identical to golf club head mold 1301 (FIG. 13). In many embodiments, the golf club head mold can include a strike portion, a rear portion, and a port structure at least partially defined within the rear portion. The strike portion can be similar or identical to strike portion 1310 (FIG. 13). The rear portion can be similar or identical to rear portion 1320 (FIG. 13). The port structure can be similar or identical to port structure 1336. In some embodiments, the portion of the tooling piece can be substantially conformal with the port structure. In many embodiments, the golf club head mold can be molded through injection molding using a wax or another suitable molding material. In many embodiments, the wax can solidify to form the golf club head mold before performing the next block of method 1500.

In a number of embodiments, method 1500 further can include a block 1550 of opening the second mold piece from the first mold piece, or vice versa, such that the tooling piece is rotated about the fixed point away from the mold position in the port structure to the release position. For example, the second mold piece can be opened from the first mold piece as second mold piece 1381 is opened from first mold piece 1380 in FIG. 14. The golf club head mold can be simultaneously removed from the first mold piece, the second mold piece, and the tooling piece, and then used for investment casting, according to conventional investment casting processes. For example, the golf club head mold can be coated with a ceramic casting; the wax of the golf club head mold can be melted out of the ceramic casting; a metal can be poured into the ceramic casting to form the golf club head; and the ceramic casting can be divested from the golf club head.

Figure 16:
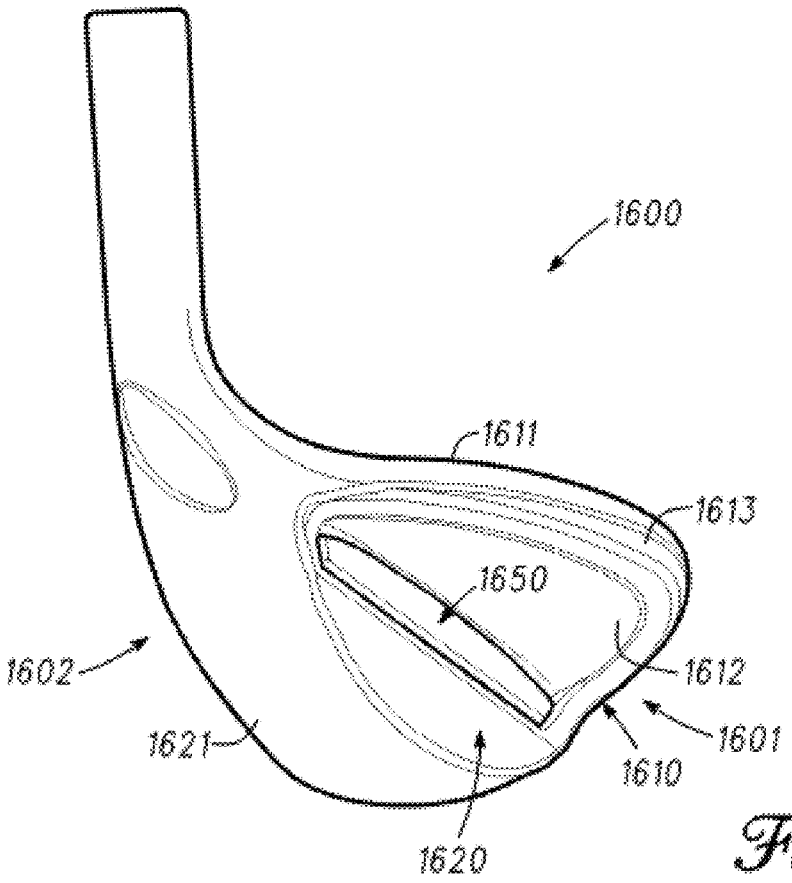
FIG. 16 illustrates a heel-side, bottom, rear perspective view of a golf club head with an insert, according to yet another embodiment.
Figure 17:
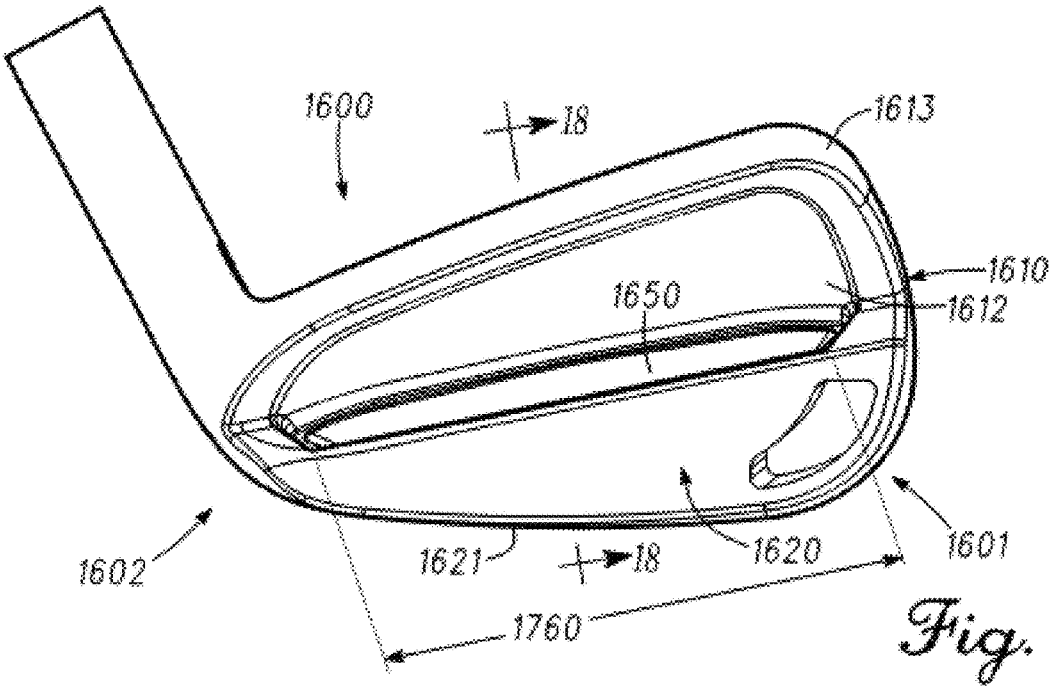
FIG. 17 illustrates a bottom, rear view of the golf club head of FIG. 16 with the insert of FIG. 16.

FIG. 16 illustrates a heel-side, bottom, rear perspective view of a golf club head 1600 similar to golf club head 100 (FIG. 1) with an insert 1650, according to an embodiment. FIG. 17 illustrates a bottom, rear view of golf club head 1600 with insert 1650. FIG. 18 illustrates a side cross-sectional view of a golf club head 1600, where the cross-sectional view is taken along cross-sectional line 18-18 in FIG. 17, but where golf club head 1600 in FIG. 18 is illustrated without insert 1650, according to an embodiment. FIG. 20 illustrates a side cross-sectional view along line 18-18 in FIG. 17 of golf club head 1600 with insert 1650.

In many embodiments, insert 1650 can be similar to tuning element 150 (FIGS. 1 and 6-8). In some embodiments, insert 1650 can be a part of the tuning element or custom tuning port (CTP) weight. In many embodiments, insert 1650 can improve vibration dampening and sound reduction on impact with a golf ball. Golf club head 1600 is merely exemplary and embodiments of the golf club head are not limited to the embodiments presented herein. The golf club head can be employed in many different embodiments or examples not specifically depicted or described herein. In a number of embodiments, golf club head 1600 can be an iron-type club head, a wedge-type club head, or a hybrid-type club head. For example, in some embodiments, golf club head 1600 can have a loft angle of approximately 15 degrees to approximately 70 degrees. In a number of embodiments, golf club head 1600 can have a head weight of approximately 200 grams (g) to approximately 325 g. In various embodiments, golf club head 100 can have a lie angle of approximately 50 degrees to approximately 70 degrees. In many embodiments, golf club head 1600 can include a toe end 1601 and a heel end 1602.

In various embodiments, golf club head 1600 can include a strike portion 1610, which can include a strikeface 1611 and a backface 1612. In certain embodiments, strikeface 1611 can be an insert, such as a strikeplate insert (not shown) in strike portion 1610. In other embodiments, strikeface 1611 can be integral with strike portion 1610. Backface 1612 can be opposite strikeface 1611. In many embodiments, strikeface 1611 can comprise an upper region 1841 (FIG. 18) and a lower region 1843 (FIG. 18). In these embodiments, upper region 1841 can comprise a region of the strike portion 1610 above cavity opening 1832 of port structure 1830 or between cavity opening 1832 of port structure 1830 and top of strike portion 1610. Further, in these embodiments, lower region 1843 can comprise a region of the strike portion 1610 below cavity opening 1832 of port structure 1830 or between cavity opening 1832 or port structure 1830 and bottom end of strike portion 1610.

In some embodiments, a minimum upper thickness 1842 (FIG. 18) of upper region 1841 (FIG. 18) can be measured from strikeface 1611 to backface 1612 in a direction substantially perpendicular to strikeface 1611. In many embodiments, minimum upper thickness 1842 (FIG. 18) can be approximately 0.06 inch (0.152 cm) to approximately 0.1 inch (0.254 cm). In many embodiments, minimum upper thickness 1842 can be less than or equal to approximately 0.10 inch (0.254 cm), less than or equal to approximately 0.09 inch (0.2286 cm), less than or equal to approximately 0.08 inch (0.2032 cm), less than or equal to approximately 0.07 inch (0.1778 cm), or less than or equal to approximately 0.06 inch (0.1524 cm). For example, in some embodiments, minimum upper thickness 1842 can be approximately 0.06 inch (0.1524 cm), 0.07 inch (0.1778 cm), 0.08 inch (0.2032 cm), 0.09 inch (0.2286 cm), or 0.1 inch (0.254 cm).

In some embodiments, a minimum lower thickness 1844 (FIG. 18) of lower region 1843 (FIG. 18) can be measured from strikeface 1611 to a front wall 1836 (FIG. 18) of slot 1831 (FIG. 18) in a direction substantially perpendicular to strikeface 1611, and as described further below. In many embodiments, minimum lower thickness 1844 (FIG. 18) can be less than minimum upper thickness 1842 (FIG. 18). In some embodiments, minimum lower thickness 1843 (FIG. 18) of lower region 1843 (FIG. 18) can be approximately 0.05 inch (0.127 cm) to approximately 0.09 inch (0.2286 cm). In many embodiments, minimum lower thickness 1843 can be less than or equal to approximately 0.09 inch (0.2286 cm), less than or equal to approximately 0.08 inch (0.2032 cm), less than or equal to approximately 0.07 inch (0.1778 cm), less than or equal to approximately 0.06 inch (0.1524 cm), or less than or equal to approximately 0.05 inch (0.127 cm). For example, in some embodiments, minimum lower thickness 1844 (FIG. 18) can be approximately 0.05 inch (0.127 cm), 0.06 inch (0.1524 cm), 0.07 inch (0.1778 cm), 0.08 inch (0.2032 cm), or 0.09 inch (0.2286 cm).

In many embodiments, a minimum thickness of the strikeface 1611 including the upper region 1841 and lower region 1843, measured in a direction substantially perpendicular to strikeface 1611, can be less than or equal to approximately 0.10 inch (0.254 cm), less than or equal to approximately 0.09 inch (0.2286 cm), less than or equal to approximately 0.08 inch (0.2032 cm), less than or equal to approximately 0.07 inch (0.1778 cm), less than or equal to approximately 0.06 inch (0.1524 cm), or less than or equal to approximately 0.05 inch (0.127 cm).

Also, in many embodiments, a portion 1891 of strikeface 1611 is located between minimum lower thickness 1844 and minimum upper thickness 1842. Portion 1891 of strikeface 1611 can have a thickness that is thicker than minimum lower thickness 1844 and that is also thicker than minimum upper thickness 1842. This higher thickness of portion 1891 can provide additional support for strikeface 1611, including both lower region 1843 of strikeface 1611 and upper region 1741 of strikeface 1611. In these embodiments, the rate of change in thickness of strikeface 1611 is not constant from the top rail to sole 1621 of golf club head 1600, and the direction of change in thickness of strikeface 1611 is not constant from the top rail to sole 1621 of golf club head 1600. Golf club head 100 (FIGS. 9 & 10) and golf club head 1900 (FIG. 20) can have a similar, although not necessarily identical, configuration.

In many embodiments, insert 1650 can provide support to at least a portion strikeface 1611 (e.g. lower region 1843, or upper region 1841 and lower region 1843 of strikeface 1611). In many embodiments, the area of the strikeface 1611 supported by insert 1650 can be positioned below a geometric center of strikeface 1611. In other embodiments, the area of the strikeface 1611 supported by insert 1650 can extend above the geometric center of the strikeface 1611.

In many embodiments, the area of strikeface 1611 supported by insert 1650 can be approximately 0.75-2.25 $in^2$ (4.84-14.52 $cm^2$). In some embodiments, the area of strikeface 1611 supported by insert 1650 can be greater than 0.75 $in^2$ (4.84 $cm^2$), greater than 1.0 $in^2$ (6.45 $cm^2$), greater than 1.25 $in^2$ (8.06 $cm^2$), greater than 1.5 $in^2$ (9.68 $cm^2$), greater than 1.75 $in^2$ (11.29 $cm^2$), greater than 2.0 $in^2$ (12.90 $cm^2$), or greater than 2.25 $in^2$ (14.52 $cm^2$). For example, in many embodiments, the area of strikeface 1611 supported by insert 1650 can be approximately 0.75-2.0 $in^2$ (4.84-12.90 $cm^2$), approximately 1.0-2.0 $in^2$ (6.45-12.90 $cm^2$), approximately 1.0-1.75 $in^2$ (6.45-11.29 $cm^2$), or approximately 1.25-1.75 $in^2$ (8.06-11.29 $cm^2$).

Further, in many embodiments, the area of strikeface 1611 supported by insert 1650 can be approximately 15-50% of the surface area of the strikeface 1611. In some embodiments, the area of strikeface 1611 supported by insert 1650 can be greater than 15%, greater than 20%, greater than 25%, or greater than 30% of the surface area of the strikeface 1611. For example, in many embodiments, the area of strikeface 1611 supported by insert 1650 can be approximately 20-45%, approximately 25-40%, approximately 25-35%, or approximately 25-45% of the surface area of the strikeface 1611.

The support provided to strikeface 1611 by insert 1650 can allow a thinner strikeface 1611 where strikeface 1611 is supported by insert 1650. For example, in many embodiments, insert 1650 supports lower region 1843 of strikeface 1611 allowing minimum lower thickness 1844 to be less than minimum upper thickness 1842. Minimum lower thickness 1844 described herein allows more deflection of strikeface 1611 during impact than a strikeface having a lower minimum thickness similar to the upper minimum thickness. Increased deflection of strikeface 1611 can result in increased energy transfer to the ball and increased travel distance for the ball.

Further, thinning of the strikeface 1611 reduces club head weight, thereby increasing the available discretionary mass to be advantageously positioned elsewhere on the club head. In many embodiments, thinning of the strikeface 1611 can increase discretionary mass of the club head by greater than 0.5 grams, greater than 2.5 grams, greater than 5.0 grams, greater than 7.5 grams, greater than 10.0 grams, greater than 12.5 grams, greater than 15.0 grams, greater than 17.5 grams, or greater than 20.0 grams. Repositioning mass from near the strikeface of the club head (e.g. on the rear, low toe area) can increase club head moment of inertia to improve consistency in ball direction and distance for off center hits.

In many embodiments, the club head 1600 has a heel to toe moment of inertia greater than approximately 380 $g \cdot in^2$ (2,452 $g \cdot cm^2$), greater than approximately 385 $g \cdot in^2$ (2,484 $g \cdot cm^2$), greater than approximately 390 $g \cdot in^2$ (2,516 $g \cdot cm^2$), greater than approximately 395 $g \cdot in^2$ (2,548 $g \cdot cm^2$), greater than approximately 400 $g \cdot in^2$ (2,581 $g \cdot cm^2$), greater than approximately 405 $g \cdot in^2$ (2,613 $g \cdot cm^2$), greater than approximately 410 $g \cdot in^2$ (2,645 $g \cdot cm^2$), greater than approximately 415 $g \cdot in^2$ (2,677 $g \cdot cm^2$), greater than approximately 420 $g \cdot in^2$ (2,710 $g \cdot cm^2$), greater than approximately 425 $g \cdot in^2$ (2,742 $g \cdot cm^2$), greater than approximately 450 $g \cdot in^2$ (2,903 $g \cdot cm^2$), greater than approximately 500 $g \cdot in^2$ (3,226 $g \cdot cm^2$), greater than approximately 550 $g \cdot in^2$ (3,548 $g \cdot cm^2$), or greater than approximately 600 $g \cdot in^2$ (3,871 $g \cdot cm^2$), wherein the heel to toe moment of inertia is measured about an axis extending through the club head center of gravity in a direction from the top to the bottom of the club head. In other embodiments, the heel to toe moment of inertia can be approximately 380-600 $g \cdot in^2$ (2,452-3,871 $g \cdot cm^2$), approximately 400-600 $g \cdot in^2$ (2,581-3,871 $g \cdot cm^2$), approximately 500-600 $g \cdot in^2$ (3,226-3,871 $g \cdot cm^2$), or approximately 550-600 $g \cdot in^2$ (3,548-3,871 $g \cdot cm^2$).

Further, in many embodiments, the club head 1600 has a top to bottom moment of inertia greater than approximately 95 $g \cdot in^2$ (613 $g \cdot cm^2$), greater than approximately 96 $g \cdot in^2$ (619 $g \cdot cm^2$), greater than approximately 97 $g \cdot in^2$ (626 $g \cdot cm^2$), greater than approximately 98 $g \cdot in^2$ (632 $g \cdot cm^2$), greater than approximately 99 $g \cdot in^2$ (639 $g \cdot cm^2$), greater than approximately 100 $g \cdot in^2$ (645 $g \cdot cm^2$), greater than approximately 101 $g \cdot in^2$ (652 $g \cdot cm^2$), greater than approximately 102 $g \cdot in^2$ (658 $g \cdot cm^2$), greater than approximately 103 $g \cdot in^2$ (665 $g \cdot cm^2$), greater than approximately 104 $g \cdot in^2$ (671 $g \cdot cm^2$), greater than approximately 105 $g \cdot in^2$ (677 $g \cdot cm^2$), greater than approximately 106 $g \cdot in^2$ (684 $g \cdot cm^2$), greater than approximately 125 $g \cdot in^2$ (806 $g \cdot cm^2$), greater than approximately 150 $g \cdot in^2$ (968 $g \cdot cm^2$), greater than approximately 175 $g \cdot in^2$ (1,129 $g \cdot cm^2$), or greater than approximately 200 $g \cdot in^2$ (1,290 $g \cdot cm^2$), wherein the heel to toe moment of inertia is measured about an axis extending through the club head center of gravity in a direction from the heel to the toe of the club head. In other embodiments, the top to bottom moment of inertia can be approximately 95-200 $g \cdot in^2$ (613-1,290 $g \cdot cm^2$), approximately 100-200 $g \cdot in^2$ (645-1,290 $g \cdot cm^2$), approximately 125-600 $g \cdot in^2$ (806-1,290 $g \cdot cm^2$), or approximately 150-600 $g \cdot in^2$ (986-1,290 $g \cdot cm^2$).

For example, in one embodiment, an exemplary club head 1600 comprises minimum upper thickness 1842 of approximately 0.080 inches (0.203 cm), minimum lower thickness 1844 of approximately 0.068 inches (0.172 cm), an area of strikeface 1611 supported by insert 1650 of approximately 1.17 $in^2$ (7.55 $cm^2$) (or approximately 26.2% of the surface area of the strikeface 1611). In this example, the exemplary club head has approximately 9.3 grams of discretionary mass compared to a similar control club head having a thicker face and a reduced contact area of insert with strikeface. Further, in this example, the exemplary club head has a heel to toe moment of approximately 2.8% greater than the control club head. Further still, in this example, the exemplary club head has a top to bottom moment of inertia of approximately 2.3% greater than the control club head. In this example, the control club head comprises a minimum upper thickness of approximately 0.075 inches (0.191 cm), and a minimum lower thickness of approximately 0.137 inches (0.348 cm), and an area of the strikeface supported by the insert of approximately 0.65 $in^r$ (4.19 $cm^2$) (or approximately 14.5% of the surface area of the strikeface).

In various embodiments, backface 1612 can include a perimeter portion 1613 at a top end of backface 1612. In many embodiments, perimeter portion 1613 can extend around the top end and sides of backface 1612 at or proximate to toe end 1601 and/or heel end 1602. Perimeter portion 1613 can protrude rearward from backface 1612. In some embodiments, a transition angle 1887 from strikeface 1611 to perimeter portion 1613 can be less than approximately 40 degrees. In some embodiments, transition angle 1887 can be more than approximately 60 degrees. In many embodiments, transition angle 1887 can be approximately 5 degrees, 10 degrees, 15 degrees, 20, degrees, 25 degrees, 30 degrees, 31 degrees, 32 degrees, 33 degrees, 34 degrees, 35 degrees, 36 degrees, 37 degrees, 38 degrees, 39 degrees, 61 degrees, 62 degrees, 63 degrees, 64 degrees, 65 degrees, 66 degrees, 67 degrees, 68 degrees, 69 degrees, 70 degrees, 75 degrees, 80 degrees, 85 degrees, or 90 degrees.

In various embodiments, golf club head 1600 can include a rear portion 1620. Rear portion 1620 can be coupled to strike portion 1610 at the bottom end of strike portion 1610. Rear portion 1620 can include a sole 1621. In a number of embodiments, at least a portion of sole 1621 can be substantially or approximately horizontal when golf club head 1600 is at the address position, such that cross-sectional line 18-18 (FIG. 17) can be substantially or approximately vertical when golf club head 100 is at the address position. In many embodiments, strike portion 1610 can be integral with rear portion 1620, such that strike portion 1610 and rear portion 1620 can be a single piece of material. In other embodiments, strike portion 1610 can be a separate piece (or more than one separate piece) of material fastened to rear portion 1620, such as by welding, brazing, adhering, and/or other mechanical or chemical fasteners. In many embodiments, rear portion 1620 and/or strike portion 1610 can include one or more materials, including ferrous materials such as steel, carbon steel, stainless steel, and/or steel alloys, and/or non-ferrous materials such as titanium, tungsten, and/or aluminum. In a number of embodiments, one or more of the materials used in rear portion 1620 and/or strike portion 1610 can have a high shear modulus and/or a high strength-to-weight ratio.

In a number of embodiments, golf club head 1600 can include insert 1650 and a port structure for holding and/or securing insert 1650, such as port structure 1830 (as shown in FIG. 18 and described below). In many embodiments, insert 1650 can be located within and substantially conformal with port structure 1830. In many embodiments, port structure 1830 can be similar to port structure 330 (FIG. 3). In some embodiments, insert 1650 can provide support and elasticity for strikeface 1611. In some embodiments, insert 1650 can provide support to the geometric center of strikeface 1611. In many embodiments, insert 1650 can reduce stress on strikeface 1611. In some embodiments, the support that insert 1650 provides to strikeface 1611 can allow for a thinner strikeface and therefore increased bending of strikeface 1611 during impact with the golf ball, while providing structural support to maintain durability of strikeface 1611 and preventing failure of strikeface 1611. On impact with the golf ball, increased bending of strikeface 1611 can increase energy transfer to the golf ball. This can increase golf ball speed and distance and result in better distance control.

In some embodiments, insert 1650 can be made from any material having a shore hardness of approximately 20 A to approximately 80 A. For example, in some embodiments, insert 1650 can be made from any material having a shore hardness of 20 A-30 A, 30 A-40 A, 40 A-50 A, 50 A-60 A, 60 A-70 A, or 70 A-80 A. In some embodiments, insert 1650 can comprise an insert having two or more portions, and at least two of the two or more portions can be made of different materials. In embodiments comprising an insert comprising two or more portions, the average shore hardness of insert 1650 is approximately 20 A to approximately 80 A. For example, in some embodiments, the average shore hardness of insert 1650 can be approximately 20 A-30 A, 30 A-40 A, 40 A-50 A, 50 A-60 A, 60 A-70 A, or 70 A-80 A.

In some embodiments, a first portion of the two or more portions of the insert can be positioned closer to strikeface 1611 than a second portion of the two or more portions of the insert. In other embodiments, the first portion of the two or more portions of the insert can be positioned closer to the top of the backface of the golf club head and the second portion of the two or more portions of the insert can be positioned closer to the sole of the golf club head. In many embodiments, the first portion of the two or more portions of the insert can be made of a first material and the second portion of the two or more portions of the insert can be made of a second material. In some embodiments, the first material can have a shore hardness greater than the second material. In other embodiments, the first material can have a shore hardness less than the second material. In some embodiments, the first and/or second material can have a shore hardness less than 20 A or greater than 40 A such that the average shore hardness is approximately 20 A-80 A. In some embodiments, the first and/or second material can have a shore hardness greater than the average shore hardness (e.g., greater than 80 A) and can include voids in the structure of the insert filled with air to lower the equivalent shore hardness within the range of approximately 20 A to approximately 80 A. In some embodiments, the first and/or second material can have a shore hardness less than the average shore hardness (e.g. less than 20 A) and can include additives (e.g. metal powder additives such as tungsten or other heavy metals) in the structure of the insert to increase the equivalent shore hardness within the range of approximately 20 A to approximately 80 A.

In many embodiments, insert 1650, or any portion of insert 1650, can be made of any elastically flexible material. In certain embodiments, insert 1650, or any portion of insert 1650, can be made of one or more elastomers. In some embodiments, insert 1650, or any portion of insert 1650, can be made of nonferrous thermoplastic urethane, thermoplastic elastomeric polymer(s), hybrid plastics with a mix of ferrous particles or other alloy ferrous particles mixed into polyurethane, crystalline polymer, piezoelectric polymer, amorphous polymer, urethane polymer, thermoplastic elastomer, silicones, foam, or other elastomeric polymers or rubber. In other embodiments, insert 1650, or any portion of insert 1650, can be a metal such as aluminum, steel, tungsten, or other suitable metals, such as when insert 1650 is sintered or machined. A simulation was performed to determine the stresses on the strike face of a golf club having an insert made of rubber compared to no insert. The results showed a reduction in stresses on the strikeface by approximately 10 kilopounds per square inch (KSI) for the golf club head having the insert made of rubber.

In some embodiments, the first portion of the two or more portions of the insert can have a first thickness and the second portion of the two or more portions of the insert has a second thickness, and the first thickness is less than the second thickness. In many embodiments, the first thickness and the second thickness are each constant along the length of the insert. In other embodiments, the first thickness and/or the second thickness can have varying thicknesses along the length of the insert. In some examples, the first thickness can increase in any capacity including linear, exponential, polynomial, rational, logarithmic, or any combination of the described variations in a direction toward the top end of the backface of the golf club head or toward the sole of the golf club head. In the same or other embodiments, the second thickness can increase in any capacity including linear, exponential, polynomial, rational, logarithmic, or any combination of the described variations in a direction toward the top end of the backface of the golf club head or toward the sole of the golf club head. In some embodiments, as the first thickness increases in a particular direction, the second thickness can decrease in the particular direction. In other embodiments, as the second thickness increases in a particular direction, the first thickness can decrease in the particular direction. In other embodiments, the first thickness can be greater than or equal to the second thickness. In still other embodiments, the second thickness can be greater than the first thickness.

Turning ahead in the drawings and discussing FIGS. 18-19 and 20 together, port structure 1830 can be at least partially defined within rear portion 1620. In certain embodiments, port structure 1830 can be at least partially defined within strike port 1610. In many embodiments, port structure 1830 can be defined within both rear portion 1620 and strike portion 1610. In certain other embodiments, port structure 1830 can be defined solely within rear portion 1620.

In various embodiments, port structure 1830 can be similar to port structure 330 (FIG. 3). Port structure 1830 can include a slot 1831, similar to slot 331 (FIG. 3) which can extend from a slot opening 1832 to a slot base 1833. In many embodiments, slot 1831 can be configured to receive a main portion 2051 (FIG. 20) of insert 1650 (FIGS. 16-17). In many embodiments, slot 1831 can include a toe wall 1834 and a heel wall. The heel wall can be similar to heel wall 537 (FIG. 5). Toe wall 1834 can be at the side of golf club head 1600 and/or slot 1831 located closer to toe end 1601 (FIGS. 16-17), and the heel wall can be at the side of golf club head 1600 and/or slot 1831 located closer to heel end 1602 (FIGS. 16-17). Slot 1831 can extend between toe wall 1834 and the heel wall. In many embodiments, toe wall 1834 and/or the heel wall can extend from slot opening 1832 to slot base 1833.

In a number of embodiments, slot 1831 can include a rear wall 1835 and a front wall 1836. In various embodiments, rear wall 1835 can extend from slot opening 1832 to slot base 1833, and/or can extend between the heel wall and toe wall 1834. In some embodiments, front wall 1836 can extend from slot opening 1832 to slot base 1833, and/or can extend between the heel wall and toe wall 1834. Slot 1831 can extend between front wall 1836 and rear wall 1835. In a number of embodiments, strike face 1611 can be located closer to front wall 1836 than rear wall 1835. In some embodiments, front wall 1835 also can be located closer to strikeface 1611 than rear wall 1835.

In many embodiments, port structure 1830 can be curved similar to port structure 330. For example, front wall 1836 can be curved and have a front wall curvature in the first direction extending between slot opening 1832 and slot base 1833. As another example, rear wall 1835 can be curved and have a rear wall curvature in the first direction extending between slot opening 1832 and slot base 1833.

In many embodiments, a slot width 1760 can be measured from the heel wall and toe wall 1834. In some embodiments, slot width 1760 can be approximately 1.0 inch (2.54 cm) to approximately 3.0 inches (7.62 cm). In some embodiments, slot width 1760 can be approximately 1.0 inch (2.54 cm), 1.1 inches (2.794 cm), 1.2 inches (3.048 cm), 1.3 inches (3.302 cm), 1.4 inches (3.556 cm), 1.5 inches (3.81 cm), 1.6 inches (4.064 cm), 1.7 inches (4.318 cm), 1.8 inches (4.572 cm), 1.9 inches (4.826 cm), 2.0 inches (5.08 cm), 2.1 inches (5.334 cm), 2.2 inches (5.588 cm), 2.3 inches (5.842 cm), 2.4 inches (6.096 cm), 2.5 inches (6.25 cm), 2.6 inches (6.604 cm), 2.7 inches (6.858 cm), 2.8 inches (7.112 cm), 2.9 inches (7.366 cm), or 3.0 inches (7.62 cm). In certain embodiments, slot width 1760 (FIG. 17) can be approximately 2.66 inches (6.756 cm). In many embodiments, a slot depth 1872 can be measured from a top of rear wall 1835 to slot base 1833. In some embodiments, slot depth 1872 can be approximately 0.45 inch (1.143 cm) to approximately 0.60 inch (1.524 cm). In some embodiments, slot depth 1872 can be approximately 0.45 inch (1.143 cm), 0.5 inch (1.27 cm), 0.55 inch (1.397 cm), or 0.6 inch (1.524 cm). In certain embodiments, slot depth 1872 can be approximately 0.532 inch (1.351 cm).

As shown in FIG. 20, port structure 1830 can be configured to receive and/or secure insert 1650. Main portion 2031 of insert 1650 can fit within and/or be substantially conformal with slot 1831, and/or cap 2061 of insert 1650 can fit within cap recess 1840 (FIG. 18). In many embodiments, main portion 2031 can be similar to main portion 651 (FIG. 6), and cap 2061 can be similar to cap 661 (FIG. 6). In many embodiments, main portion 2031 of insert 1650 can include an insert rear side 2055, an insert front side 2056 and/or an insert bottom side 2053. In a number of embodiments, cap 2061 of insert 1650 can include a cap top side 2068. In other embodiments, cap 2061 can extend from main portion 2031 of insert 1650 at an angle relative to slot opening 1832 such that insert 1650 supports the geometric center of strikeface 1611 and/or a portion of upper region 1841 of strikeface 1611.

In a number of embodiments, port structure 1830 can be slightly larger than insert 1650 to allow insert 1650 to be inserted within port structure 1830. Insert 1650 can be adhered or otherwise affixed to port structure 1830. For example, insert 1650 can be secured within port structure using an adhesive, such as an epoxy. In certain embodiments, the epoxy can have a thickness of at least approximately 0.001 inch (0.00254 cm), and port structure 1830 can be at least approximately 0.001 inch (0.00254 cm) larger than insert 1650 in one or more directions. For example, port structure can be approximately 0.01 inch (0.0254 cm) larger than insert 1650 in each direction. In some embodiments, a larger gap can exist between insert bottom side 2053 and slot base 1833 than between other parts of insert 1650 and port structure 1830. This gap can be used to hold excess amounts of the adhesive so that the adhesive does not overflow out of slot 1831 or port structure 1830. In other embodiments, insert 1650 (with or without cap 2061) can be held in port structure 1830 using mechanical mechanisms, such as snaps, ribs, fasteners, or other suitable mechanical mechanisms.

FIG. 19 illustrates a bottom, rear view of a golf club head 1900 with insert 1950. Golf club head 1900 can be similar to golf club head 1600 (FIGS. 16-18 and 20). In many embodiments, insert 1950 can be similar to insert 1650 (FIGS. 16-17 and 20) and/or tuning element 150 (FIGS. 1 and 6-8). In many embodiments, golf club head 1900 can include a toe end 1901 and a heel end 1902.

In various embodiments, golf club head 1900 can include a strike portion 1910, which can include a strikeface 1911 and a backface 1912. In certain embodiments, strikeface 1911 can be an insert, such as a strikeplate insert (not shown) in strike portion 1910. In other embodiments, strikeface 1911 can be integral with strike portion 1910. Backface 1912 can be opposite strikeface 1911. In various embodiments, backface 1912 can include a perimeter portion 1913 at a top end of backface 1912. In many embodiments, perimeter portion 1913 can extend around the top end and sides of backface 1912 at or proximate to toe end 1901 and/or heel end 1902. Perimeter portion 1913 can protrude rearward from backface 1912.

In various embodiments, golf club head 1900 can include a rear portion 1920. Rear portion 1920 can be coupled to strike portion 1910 at the bottom end of strike portion 1910. Rear portion 1920 can include a sole 1921. In many embodiments, strike portion 1910 can be integral with rear portion 1920, such that strike portion 1910 and rear portion 1920 can be a single piece of material. In other embodiments, strike portion 1910 can be a separate piece (or more than one separate piece) of material fastened to rear portion 1920, such as by welding, brazing, adhering, and/or other mechanical or chemical fasteners.

In many embodiments, golf club head 1900 can include a cavity 1990. In some embodiments, cavity 1990 can be located at toe end 1901 and/or toward sole 1921. In many embodiments, a toe weight 1995 can be inserted in cavity 1990. In some embodiments, toe weight 1995 and cavity 1990 can be similar to the toe weight and cavity as described in U.S. patent application Ser. No. 14/306,033, filed Jun. 16, 2014, and entitled "Club Head Sets with Varying Characteristics and Related Methods," which is incorporated herein in its entirety. Toe weight 1995 can comprise various shapes and dimensional configurations. In some embodiments, toe weight 1995 can comprise a shape and dimension that is complimentary to cavity 1990, as illustrated in FIG. 19. In some embodiments, toe weight 1995 can comprise a shape and dimension that only partially fills cavity 1990. Referring to FIG. 19, in the illustrated embodiment, cavity 1990 and toe weight 1995 comprise an enclosed shape or a shape that is confined such that the toe weight 1995 can only be inserted in a single direction. In many embodiments, the toe weight 1995 can be coupled to the cavity 1990 by swaging or centrifugal co-casting when the toe weight comprises a high density tungsten alloy. In other embodiments, the toe weight 1995 can be coupled to the cavity 1990 using any other suitable method. For example, the toe weight 1995 can be coupled to the cavity by welding when the toe weight comprises a lower density tungsten alloy.

In some embodiments, toe weight 1995 may comprise a metal, and may be a single elemental metal such as iron, tungsten, or any other metal. In some embodiments, toe weight may comprise a metal, and may be a metal alloy, such as a tungsten alloy, a titanium alloy, or any other metal alloy.

In some embodiments, toe weight 1995 may comprise more than one material. For example, toe weight 1995 can have a first portion 1997 comprising a first material and a second portion 1999 comprising a second material different than the first material. The first material and second material may be single elemental metals (for example iron, tungsten, or any other metal) or metal alloys (for example titanium alloys, tungsten alloys, or any other alloy). In embodiments where the toe weight 1995 comprises the first portion 1997 and the second portion 1999, the first and second portions may be coupled by sintering, a process of compacting and forming a solid mass of material using heat and/or pressure to achieve atomic diffusion without melting the materials.

In embodiments where the toe weight 1995 comprises the first material and the second material, the first material may made of a less dense material, and the first portion 1997 comprising the first material may be positioned on an exterior of the toe weight 1995 when positioned in cavity 1990. Further, the second material may made of a more dense material, and the second portion 1999 comprising the second material may be positioned on an interior of the toe weight when positioned in cavity 1990.

For example, the first material may comprise a tungsten alloy having less than or equal to approximately 70 wt % tungsten, less than or equal to approximately 60 wt % tungsten, less than or equal to approximately 50 wt % tungsten, less than or equal to approximately 40 wt % tungsten, or less than or equal to approximately 30 wt % tungsten. Further, the first material may comprise a tungsten alloy having greater than or equal to approximately 25 wt % nickel, greater than or equal to approximately 35 wt % nickel, greater than or equal to approximately 45 wt % nickel, greater than or equal to approximately 55 wt % nickel, or greater than or equal to approximately 65 wt % nickel. Further still, the first material may comprise a tungsten alloy having a density less than or equal to approximately 14 g/cm$^3$, less than or equal to approximately 13 g/cm$^3$, less than or equal to approximately 12 g/cm$^3$, less than or equal to approximately 11 g/cm$^3$, or less than or equal to approximately 10 g/cm$^3$ (e.g. D14, D12, or D10 tungsten). For further example, the second material may comprise a tungsten alloy having greater than or equal to approximately 70 wt % tungsten, greater than or equal to approximately 75 wt % tungsten, greater than or equal to approximately 80 wt % tungsten, greater than or equal to approximately 85 wt % tungsten, or greater than or equal to approximately 90 wt % tungsten. Further, the second material may comprise a tungsten alloy having less than or equal to approximately 25 wt % nickel, less than or equal to approximately 20 wt % nickel, less than or equal to approximately 15 wt % nickel, or less than or equal to approximately 10 wt % nickel. Further still, the second material may comprise a tungsten alloy having a density greater than or equal to approximately 14 g/cm$^3$, greater than or equal to approximately 15 g/cm$^3$, greater than or equal to approximately 16 g/cm$^3$, greater than or equal to approximately 17 g/cm$^3$, greater than or equal to approximately 18 g/cm$^3$, or greater than or equal to approximately 19 g/cm$^3$ (e.g. D14, or D17 tungsten) In this example, the first portion 1997 is able to welded to the club head body around a perimeter 1992 of cavity 1990 due to the increased nickel content and/or reduced tungsten content in the first material compared to the second material, while the second material is dense enough to provide increased or maximized weight to the club head by the toe weight 1995.

For example, in one embodiment, the first material of the first portion 1997 of the toe weight 1995 can comprise a tungsten alloy having approximately 70 wt % tungsten, approximately 25 wt % nickel, and approximately 5 wt % iron, and the second material of the second portion 1999 of the toe weight 1995 can comprise a tungsten alloy having approximately 90 wt % tungsten, approximately 7 wt % nickel, and approximately 3 wt % iron.

In many embodiments, the first portion 1997 of the toe weight 1995 comprises a thickness of approximately 1.5 mm-3.0 mm. In other embodiments, the first portion 1997 comprises a thickness of greater than or equal to approximately 1.5 mm, greater than or equal to approximately 1.75 mm, greater than or equal to approximately 2.0 mm, greater than approximately 2.25 mm, or greater than or equal to approximately 2.5 mm. Further, in other embodiments, the first portion 1997 comprises a thickness of less than or equal to approximately 10 mm, less than or equal to approximately 9 mm, less than or equal to approximately 8 mm, less than or equal to approximately 7 mm, less than or equal to approximately 6 mm, less than or equal to approximately 5 mm, less than or equal to approximately 4 mm, or less than or equal to approximately 3 mm. In these embodiments, the thickness of the first portion 1997 is large enough to allow welding and post processing (e.g. grinding, sanding, or polishing) of the first portion 1997 of the toe weight 1995, and thin enough to provide maximized weight due to maximized volume of the second portion 1999 comprising the second material.

Figure 25:
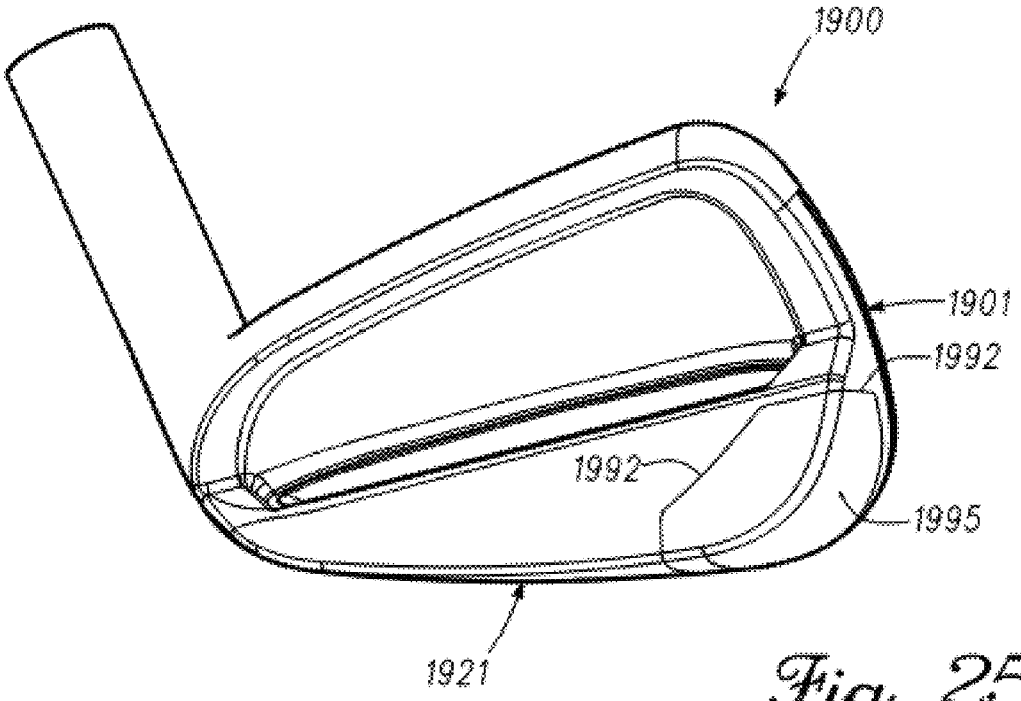
FIG. 25 illustrates a bottom, rear view of a golf club head with an insert, according to still yet another embodiment.
Figure 26:
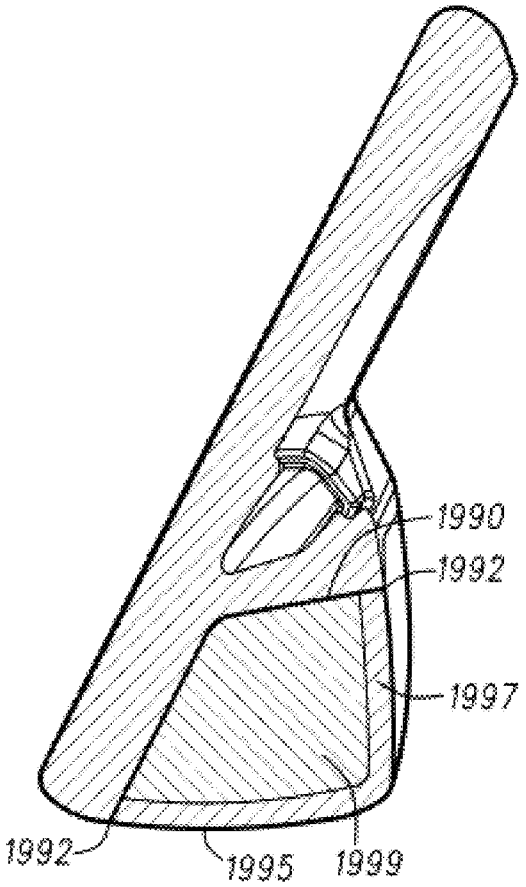
FIG. 26 illustrates a side cross-sectional view of the golf club head of FIG. 25.

In embodiments where the toe weight 1995 comprises the first and second material, as described above, the toe weight 1995 can comprise a shape and dimension that is complimentary to cavity 1990, as illustrated in FIGS. 25-26. In these embodiments, cavity 1990 and toe weight 1995 can be positioned advantageously on the toe end 1901 of the club head to increase perimeter weighting. The cavity 1990 and toe weight 1995 comprising the first and second material can be positioned at or proximate to the toe end 1901 and along the sole and/or back lower rail of the club head. For example, the cavity 1990 illustrated in FIGS. 25-26 comprises an open shape or a shape does not confine toe weight 1995 when the toe weight 1995 is positioned in the cavity 1990. Further, the cavity 1990 illustrated in FIGS. 25-26 is larger and is positioned closer to the perimeter of the club head, compared to the cavity 1990 illustrated in FIG. 19. The cavity 1990 illustrated in FIGS. 25-26 can comprise an open shape, and can be larger and positioned closer to the perimeter of the club head because the toe weight 1995 having the first portion 1997 and the second portion 1999 allows the toe weight 1995 to be welded into the cavity 1990, therefore requiring less enclosure than a toe weight that is swaged into a cavity.

Further, in some embodiments, toe weight 1995 having first portion 1997 comprising the first material and second portion 1999 comprising the second material can be coupled to the club head by welding or centrifugal co-casting, without requiring a cavity 1990. In these embodiments, toe weight 1995 can comprise a greater volume compared to a swaged toe weight positioned in a cavity. Accordingly, toe weight 1995 comprising the first and second portion 1997, 1999 can have a greater mass compared to a toe weight positioned in a cavity, thereby further increasing or maximizing the moment of inertia of the club head.

In these or other embodiments, the toe weight 1995 can comprise a volume greater than approximately 0.10 $in^3$ (1.64 $cm^3$), greater than approximately 0.12 $in^3$ (1.97 $cm^3$), greater than approximately 0.14 $in^3$ (2.29 $cm^3$), greater than approximately 0.16 $in^3$ (2.62 $cm^3$), greater than approximately 0.18 $in^3$ (2.95 $cm^3$), greater than approximately 0.20 $in^3$ (3.28 $cm^3$), greater than approximately 0.22 $in^3$ (3.61 $cm^3$), greater than approximately 0.24 $in^3$ (3.93 $cm^3$), greater than approximately 0.26 $in^3$ (4.26 $cm^3$), greater than approximately 0.28 $in^3$ (4.59 $cm^3$), or greater than approximately 0.30 $in^3$ (4.92 $cm^3$). Further, in these or other embodiments, toe weight 1995 can comprise a weight greater than approximately 10 grams, greater than approximately 11 grams, greater than approximately 12 grams, greater than approximately 13 grams, greater than approximately 14 grams, greater than approximately 15 grams, greater than approximately 16 grams, greater than approximately 17 grams, greater than approximately 18 grams, greater than approximately 19 grams, greater than approximately 20 grams, greater than approximately 21 grams, greater than approximately 22 grams, greater than approximately 23 grams, greater than approximately 24 grams, or greater than approximately 25 grams.

FIGS. 21-24 illustrate another embodiment of a golf club head 2100 with an insert 2150. Golf club head 2100 can be similar to golf club head 100, 1600, and/or 1900. In many embodiments, insert 2150 can be similar to insert 1650, 1950, and/or tuning element 150. In many embodiments, golf club head 2100 can include a slot 2131 having a front wall 2136 and a rear wall 2135. In many embodiments, insert 2150 can include a front side 2156 and a rear side 2155.

Referring to FIGS. 21-24, the rear wall 2135 of the slot 2131 may include one or more protrusions 2172, and the rear side 2155 of the insert 2015 may include one or more grooves 2174. The one or more grooves 2174 may correspond to the one or more protrusions 2172. In the illustrated embodiment, the rear wall 2135 of the slot 2131 includes two protrusions 2172 that correspond to a groove 2174 on the rear side 2155 of the insert 2150. In other embodiments, the rear wall 2135 of the slot 2131, and the rear side 2155 of the insert 2150 may include any number of protrusions 2172 such as, 1, 2, 3, 4, 5, 6, 7, 8, 9, or 10 protrusions and any number of grooves 2174, such as 1, 2, 3, 4, 5, 6, 7, 8, 9, or 10 grooves. Further, in other embodiments, the rear wall 2135 of the slot 2131 may include the one or more grooves 2174, and the rear side 2155 of the insert 2150 may include the one or more protrusions 2172.

In the same or other embodiments, the front wall 2136 of the slot 2131 may include one or more protrusions 2172 and the front side 2156 of the insert 2150 may include one or more grooves 2174. Further, in the same or other embodiments, the front wall 2136 of the slot 2131 may include the one or more grooves 2174, and the front side 2156 of the insert 2150 may include the one or more protrusions 2172. In these embodiments, the front wall 2136 of the slot 2131, and/or the front side 2156 of the insert 2150 may include any number of protrusions 2172 such as, 1, 2, 3, 4, 5, 6, 7, 8, 9, or 10 protrusions or any number of grooves 2174, such as 1, 2, 3, 4, 5, 6, 7, 8, 9, or 10 grooves.

The one or more grooves 2174 and the one or more protrusions 2172 positioned in the slot 2131 and on the insert 2150, as described above, provide mechanical stability to the insert 2150 when positioned in the slot 2131. Further, the curved shape of the front wall 2136 and/or rear wall 2135 of the slot 2131 provides mechanical stability to the insert 2150 when positioned in the slot 2131. The mechanical stability provided by the grooves 2174 and protrusions 2712 can prevent the insert 2150 from being removed from the slot 2131 during use. In some embodiments, the insert 2150 having the grooves 2174 and protrusions 2172 may be secured in the slot 2131 without the use of epoxy. In other embodiments, the insert 2150 having the grooves 2174 and protrusions 2172 may be secured in the slot 2131 with epoxy, such that the epoxy provides a secondary means of securing the insert within the slot.

Although the golf club heads with port structure, tuning elements, and related methods has been described with reference to specific embodiments, it will be understood by those skilled in the art that various changes may be made without departing from the spirit or scope of the present disclosure. For example, to one of ordinary skill in the art, it will be readily apparent that blocks 1210 and blocks 1220 of method 1200 (FIG. 12) can be comprised of many different procedures, processes, and activities and be performed by many different modules, in many different orders, that various elements of FIGS. 1-20 may be modified, and that the foregoing discussion of certain of these embodiments does not necessarily represent a complete description of all possible embodiments.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with an iron-type club, a wedge-type club, or a hybrid-type club, the apparatus, methods, and articles of manufacture described herein may be applicable to other types of golf clubs such as a driver wood-type golf club, a fairway wood-type golf club, or a putter-type golf club. Alternatively, the apparatus, methods, and articles of manufacture described herein may be applicable other type of sports equipment such as a hockey stick, a tennis racket, a fishing pole, a ski pole, etc.

Additional examples of such changes have been given in the foregoing description. Other permutations of the different embodiments having one or more of the features of the various figures are likewise contemplated. Accordingly, the disclosure of embodiments is intended to be illustrative and is not intended to be limiting. It is intended that the scope of the present disclosure shall be limited only to the extent required by the appended claims.

The golf club heads with port structure, tuning elements, and related methods discussed herein may be implemented in a variety of embodiments, and the foregoing discussion of certain of these embodiments does not necessarily represent a complete description of all possible embodiments. Rather, the detailed description of the drawings, and the drawings themselves, disclose at least one preferred embodiments, and may disclose alternative embodiments.

Clause 1: A golf club head comprising a strike portion comprising a strikeface and a backface opposite the strikeface, the backface comprising a perimeter portion at a top end of the backface, a rear portion coupled to the strike portion at a bottom end of the strike portion, and a port structure at least partially defined within the rear portion, the port structure comprising a slot extending from a slot opening to a slot base, and an insert located within and substantially conformal with the port structure, and a toe weight comprising a material having a density greater than approximately 14 g/cm$^3$, wherein an area of the strikeface supported by the insert comprises approximately 15-50% of the surface area of the strikeface, and a minimum face thickness of the strikeface, measured in a direction substantially parallel to the strikeface, is less than 0.254 cm.

Clause 2: The golf club head of clause 1, wherein the area of the strikeface supported by the insert is approximately 4.84-14.52 cm$^2$.

Clause 3: The golf club head of clause 1, wherein the toe weight comprises a weight greater than approximately 10 grams.

Clause 4: The golf club head of clause 1, wherein the toe weight comprises a weight greater than approximately 20 grams.

Clause 5: The golf club head of clause 1, wherein the toe weight comprises a volume greater than approximately 1.97 cm$^3$.

Clause 6: The golf club head of clause 1, wherein a heel to toe moment of inertia is greater than approximately 2,452 g·cm$^2$ and a top to bottom moment of inertia is greater than approximately 619 g·cm$^2$.

Clause 7: The golf club head of clause 1, wherein a minimum lower thickness of the strikeface measured from the strikeface to a front wall of the slot is less than or equal to approximately 0.2286 cm, a minimum upper thickness of the strikeface measured from the strikeface to the backface is less than approximately 0.254 cm, and the minimum lower thickness of the strikeface is less than the minimum upper thickness of the strikeface.

Clause 8: The golf club head of clause 1, wherein the minimum upper thickness of the strikeface is approximately 0.152 cm to approximately 0.254 cm.

Clause 9: The golf club head of clause 1, wherein the minimum lower thickness of the strikeface is approximately 0.127 cm to approximately 0.2286 cm.

Clause 10: The golf club head of clause 1, wherein the toe weight further comprises a first portion comprising a first material and a second portion comprising a second material.

Clause 11: The golf club head of clause 1, wherein the slot further comprises a heel wall, a toe wall, a rear wall extending from the slot opening to the slot base, and extending between the heel wall and the toe wall, the rear wall comprises a first rear wall curve along a first direction extending between the slot opening and the slot base wherein the first rear wall curve is convex in the first direction extending between the slot opening and the slot base, and a front wall extending from the slot opening to the slot base, and extending between the heel wall and the toe wall, the strikeface being located closer to the front wall than the rear wall.

Clause 12: The golf club head of clause 2, wherein the first front wall curve comprises a portion of a first circle having a first radius, the first rear wall curve comprises a portion of a second circle having a second radius, and the first circle and the second circle are approximately concentric.

Clause 13: A golf club head comprising a strike portion comprising a strikeface and a backface opposite the strikeface, the backface comprising a perimeter portion at a top end of the backface, a rear portion coupled to the strike portion at a bottom end of the strike portion, and a port structure at least partially defined within the rear portion, the port structure comprising a slot extending from a slot opening to a slot base, and wherein the slot further comprises a heel wall, a toe wall, a rear wall extending from the slot opening to the slot base, and extending between the heel wall and the toe wall, the rear wall comprises a first rear wall curve along a first direction extending between the slot opening and the slot base wherein the first rear wall curve is convex in the first direction extending between the slot opening and the slot base, and a front wall extending from the slot opening to the slot base, and extending between the heel wall and the toe wall, the strikeface being located closer to the front wall than the rear wall, and a minimum face thickness of the strikeface, measured in a direction substantially parallel to the strikeface, is less than 0.254 cm.

Clause 14: The golf club head of clause 13, further comprising an insert located within and substantially conformal with the port structure, wherein an area of the strikeface supported by the insert comprises approximately 15-50% of the surface area of the strikeface.

Clause 15: The golf club head of clause 13, further comprising a toe weight comprising a material having a density greater than approximately 14 g/cm$^3$.

Clause 16: The golf club head of clause 13, wherein the area of the strikeface supported by the insert is approximately 4.84-14.52 cm$^2$.

Clause 17: The golf club head of clause 13, wherein the toe weight comprises a weight greater than approximately 10 grams.

Clause 18: The golf club head of clause 13, wherein a heel to toe moment of inertia is greater than approximately 2,452 g·cm$^2$ and a top to bottom moment of inertia is greater than approximately 619 g·cm$^2$.

Clause 19: The golf club head of clause 13, wherein the toe weight further comprises a first portion comprising a first material and a second portion comprising a second material.

Clause 20: The golf club head of clause 13, wherein the first front wall curve comprises a portion of a first circle having a first radius, the first rear wall curve comprises a portion of a second circle having a second radius, and the first circle and the second circle are approximately concentric.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claim.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A golf club head comprising:
a strike portion comprising:
a strikeface; and
a backface opposite the strikeface, the backface comprising a perimeter portion at a top end of the backface;
a rear portion coupled to the strike portion at a bottom end of the strike portion; and
a port structure at least partially defined within the rear portion, the port structure comprising a slot extending from a slot opening to a slot base;
an insert located within and substantially conformal with the port structure;
the insert further comprising a front insert wall and a rear insert wall;
wherein the rear insert wall comprises at least one groove; and
a toe weight positioned at a toe end of the golf club head;
wherein:
the strikeface further comprises a lower region located below the slot opening of the port structure;
the lower region of the strikeface is supported by the insert, the insert supports approximately 15-50% of a total surface area of the strikeface;
the slot further comprises:
a heel wall;
a toe wall;
a rear wall extending from the slot opening to the slot base, and extending between the heel wall and the toe wall;
the rear wall comprises a first rear wall curve along a first direction extending between the slot opening and the slot base;
wherein the first rear wall curve is convex in the first direction extending between the slot opening and the slot base;
wherein the rear wall further comprises at least one protrusion;
and
a front wall extending from the slot opening to the slot base, and extending
between the heel wall and the toe wall, the front wall comprises a first front wall curve along the first direction, the strikeface being located closer to the front wall than the rear wall.

2. The golf club head of claim 1, wherein the insert rear wall comprises a plurality of grooves and the rear wall comprises a plurality of protrusions.

3. The golf club head of claim 1, wherein an area of the strikeface supported by the insert is approximately 4.84-14.52 cm2.

4. The golf club head of claim 1, wherein a heel to toe moment of inertia is greater than approximately 2,452 g·cm2 to 3,871 g·cm2, and a top to bottom moment of inertia is greater than approximately 613 g·cm2 to 1,290 g·cm2.

5. The golf club head of claim 1, wherein
a minimum lower thickness of the strikeface measured from the strikeface to a front wall of the slot;
a minimum upper thickness of the strikeface measured from the strikeface to the backface; and
the minimum lower thickness of the strikeface is less than the minimum upper thickness of the strikeface.

6. The golf club head of claim 5, wherein:
the minimum upper thickness of the strikeface is approximately 0.152 cm to approximately 0.254 cm.

7. The golf club head of claim 5, wherein:
the minimum lower thickness of the strikeface is approximately 0.127 cm to approximately 0.2286 cm.

8. The golf club head of claim 1, wherein
the toe weight further comprises a first portion comprising a first material and a second portion comprising a second material.

9. The golf club head of claim 1, wherein:
the first front wall curve comprises a portion of a first circle having a first radius;
the first rear wall curve comprises a portion of a second circle having a second radius; and
the first circle and the second circle are approximately concentric.

10. A golf club head comprising:
a strike portion comprising:
a strikeface; and a backface opposite the strikeface, the backface comprising a perimeter portion at a top end of the backface;

a rear portion coupled to the strike portion at a bottom end of the strike portion; and a port structure at least partially defined within the rear portion, the port structure comprising a slot extending from a slot opening to a slot base; and an insert located within and substantially conformal with the port structure;

the insert further comprising a front insert wall and a rear insert wall;

wherein the front insert wall comprises at least one groove;

wherein the slot further comprises:

a heel wall;

a toe wall;

a rear wall extending from the slot opening to the slot base, and extending between the heel wall and the toe wall, the rear wall comprises a first rear wall curve along a first direction extending between the slot opening and the slot base wherein the first rear wall curve is convex in the first direction extending between the slot opening and the slot base; and a front wall extending from the slot opening to the slot base, and extending between the heel wall and the toe wall;

the front wall comprises a first front wall curve along the first direction, the strikeface being located closer to the front wall than the rear wall;

wherein the front wall further comprises at least one protrusion;

and the strikeface further comprises:

an upper region located above the slot opening of the port structure, the upper region comprising a minimum upper thickness measured from the strikeface to the backface in a direction perpendicular to the strikeface;

a lower region located below the slot opening of the port structure, the lower region comprising a minimum lower thickness measured from the strikeface to the front wall of the slot in a direction perpendicular to the strikeface; and the minimum lower thickness of the strikeface is less than the minimum upper thickness of the strikeface.

11. The golf club head of claim 10, wherein the insert front wall comprises a plurality of grooves, and the front wall comprises a plurality of protrusions.

12. The golf club head of claim 10, further comprising:

a toe weight positioned at a toe end of the golf club head.

13. The golf club head of claim 10, wherein an area of the strikeface supported by the insert is approximately 4.84-14.52 cm2.

14. The golf club head of claim 10, wherein a heel to toe moment of inertia is greater than approximately 2,452 g·cm2 to 3,871 g·cm2, and a top to bottom moment of inertia is greater than approximately 613 g·cm2 to 1,290 g·cm2.

15. The golf club head of claim 10, wherein the toe weight further comprises a first portion comprising a first material and a second portion comprising a second material.

16. The golf club head of claim 10, wherein:

the first front wall curve comprises a portion of a first circle having a first radius;

the first rear wall curve comprises a portion of a second circle having a second radius; and the first circle and the second circle are approximately concentric.

17. A golf club head comprising:

a strike portion comprising:

a strikeface; and a backface opposite the strikeface, the backface comprising a perimeter portion at a top end of the backface;

a rear portion coupled to the strike portion at a bottom end of the strike portion; and a port structure at least partially defined within the rear portion, the port structure comprising a slot extending from a slot opening to a slot base; and an insert located within and substantially conformal with the port structure;

the insert further comprising a front insert wall and a rear insert wall;

wherein the front insert wall comprises at least one protrusion;

wherein the slot further comprises:

a heel wall;

a toe wall;

a rear wall extending from the slot opening to the slot base, and extending between the heel wall and the toe wall, the rear wall comprises a first rear wall curve along a first direction extending between the slot opening and the slot base wherein the first rear wall curve is convex in the first direction extending between the slot opening and the slot base; and a front wall extending from the slot opening to the slot base, and extending between the heel wall and the toe wall;

the front wall comprises a first front wall curve along the first direction, the strikeface being located closer to the front wall than the rear wall;

wherein the front wall further comprises at least one groove;

and the strikeface further comprises:

an upper region located above the slot opening of the port structure, the upper region comprising a minimum upper thickness measured from the strikeface to the backface in a direction perpendicular to the strikeface;

a lower region located below the slot opening of the port structure, the lower region comprising a minimum lower thickness measured from the strikeface to the front wall of the slot in a direction perpendicular to the strikeface; and the minimum lower thickness of the strikeface is less than the minimum upper thickness of the strikeface.

18. The golf club head of claim 17, wherein the insert front wall comprises a plurality of protrusions, and the front wall comprises a plurality of grooves.

* * * * *